US008684815B2

(12) United States Patent
Inamura

(10) Patent No.: US 8,684,815 B2
(45) Date of Patent: Apr. 1, 2014

(54) GAMING MACHINE AND GAMING METHOD THEREOF

(75) Inventor: Yukinori Inamura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1182 days.

(21) Appl. No.: 11/952,256

(22) Filed: Dec. 7, 2007

(65) Prior Publication Data

US 2008/0146313 A1 Jun. 19, 2008

(30) Foreign Application Priority Data

Dec. 14, 2006 (JP) ..... 2006-337425

(51) Int. Cl.
*A63F 9/24* (2006.01)

(52) U.S. Cl.
USPC ..... 463/20; 463/16; 463/17; 463/18; 463/19

(58) Field of Classification Search
USPC ..... 463/20
See application file for complete search history.

(56) References Cited

U.S. PATENT DOCUMENTS 6,224,483 B1 5/2001 Mayeroff
6,375,570 B1 4/2002 Poole
2003/0060266 A1 3/2003 Baerlocher
2004/0192431 A1 * 9/2004 Singer et al. ..... 463/20
2004/0195773 A1 10/2004 Masci et al.
2005/0054429 A1 3/2005 Baerlocher et al.
2005/0170876 A1 8/2005 Masci et al.
2005/0266917 A1 * 12/2005 Glavich et al. ..... 463/20
2006/0068889 A1 3/2006 Okada
2006/0287062 A1 * 12/2006 Okada ..... 463/20
2007/0060265 A1 * 3/2007 Marks et al. ..... 463/16
2007/0225060 A1 * 9/2007 Yoshimura ..... 463/20

FOREIGN PATENT DOCUMENTS

JP 2006-095073 A 4/2006

OTHER PUBLICATIONS

MO Office Action dtd Mar. 12, 2009, Macao Appln. I/6751.

* cited by examiner

*Primary Examiner* — Ronald Laneau
*Assistant Examiner* — Justin Myhr
(74) *Attorney, Agent, or Firm* — KMF Patent Services, PLLC; S. Peter Konzel; Kenneth M. Fagin

(57) ABSTRACT

A gaming environment is described. In a base game, one or more paylines to be activated and a bet number for the activated paylines are set. If a combination of displayed symbols on the activated payline is a winning combination, an outcome amount is calculated by multiplying a payout number corresponding to the realized winning combination by the bet number, and the calculated outcome amount will be provided to the player. Also, a payout number corresponding to the number of the activated paylines will be additionally provided to the player.

14 Claims, 28 Drawing Sheets

| REEL5A | REEL5B | REEL5C | REEL5D | REEL5E |
|---|---|---|---|---|
| Queen | Radar | Periscope | Lifevest | Periscope |
| Radar | Periscope | Captain | Scuba | Captain |
| King | Scuba | Radar | Ace | Radar |
| Ace | Ace | Submarine | Submarine | Submarine |
| Submarine | Submarine | Queen | Periscope | Ace |
| Queen | Queen | Scuba | King | Lifevest |
| Captain | King | Gold Box | Submarine | Submarine |
| Captain | Radar | Jack | Periscope | King |
| Gold Box | Gold Box | Radar | Queen | Captain |
| King | Queen | Gold Box | Clam | Submarine |
| Scuba | Captain | Queen | Captain | Periscope |
| Ace | Ace | Captain | Ace | King |
| Captain | King | Gold Box | Captain | Scuba |
| Captain | Captain | King | Clam | Clam |
| Gold Box | Queen | Periscope | Radar | Queen |
| Queen | Ace | Clam | Queen | Scuba |
| Captain | Periscope | Ace | Periscope | Captain |
| Clam | Captain | Periscope | Lifevest | Clam |
| Queen | Ace | Clam | Radar | Periscope |
| Submarine | Periscope | Radar | Captain | Scuba |
| Scuba | King | Captain | Captain | Queen |
| Lifevest | Captain | Gold Box | Periscope | Clam |
| King | Periscope | Lifevest | Radar | Lifevest |
| Ace | Ace | Ace | Lifevest | Radar |
| Periscope | Captain | Captain | King | Ace |
| Scuba | Lifevest | Gold Box | Captain | Captain |
| Lifevest | Queen | Lifevest | Radar | Queen |
| Queen | Clam | Ace | Scuba | Periscope |
| King | Ace | Captain | Captain | King |
| Ace | King | Lifevest | Ace | Clam |
| Captain | Gold Box | King | Periscope | Lifevest |
| Gold Box | Periscope | Scuba | Radar | Captain |
| Periscope | Lifevest | Queen | Scuba | Periscope |
| Captain | Queen | Periscope | Queen | Captain |
| Lifevest | Radar | Radar | Lifevest | Scuba |
| Ace | Captain | Ace | Radar | Lifevest |
| Radar | Submarine | Captain | Captain | Periscope |
| Captain | King | Scuba | King | Radar |
| King | Queen | King | Scuba | Scuba |
| Periscope | Radar | Jack | Captain | Ace |
| Captain | Periscope | Lifevest | Radar | Radar |
| Queen | King | Queen | Captain | Periscope |
| Ace | Jack | Radar | Lifevest | Scuba |
| King | Scuba | Scuba | Periscope | Captain |
| Radar | Periscope | Lifevest | Captain | Radar |
| Jack | Queen | Ace | Queen | Lifevest |
| King | Scuba | Periscope | Radar | Ace |
| | | King | Scuba | Queen |
| | | Captain | Jack | King |
| | | Radar | Ace | Jack |
| | | Scuba | | |

FIG. 4

| REEL5A | REEL5B | REEL5C | REEL5D | REEL5E |
|---|---|---|---|---|
| Queen | Radar | Periscope | Lifevest | Periscope |
| Radar | Periscope | Jack | Scuba | Captain |
| King | Scuba | Radar | Ace | Radar |
| Ace | Ace | Submarine | Submarine | Submarine |
| Submarine | Submarine | Queen | Periscope | Ace |
| Queen | Queen | Scuba | King | Lifevest |
| Jack | King | Gold Box | Submarine | Submarine |
| Captain | Radar | Jack | Periscope | King |
| Gold Box | Gold Box | Radar | Queen | Captain |
| King | Queen | Gold Box | Clam | Submarine |
| Scuba | Captain | Queen | Captain | Periscope |
| Ace | Ace | Jack | Ace | King |
| Jack | King | Gold Box | Jack | Scuba |
| Captain | Captain | King | Clam | Clam |
| Gold Box | Queen | Periscope | Radar | Queen |
| Queen | Ace | Clam | Queen | Scuba |
| Captain | Periscope | Ace | Periscope | Captain |
| Clam | Jack | Periscope | Lifevest | Clam |
| Queen | Ace | Clam | Radar | Periscope |
| Submarine | Periscope | Radar | Captain | Scuba |
| Scuba | King | Captain | Jack | Queen |
| Lifevest | Jack | Gold Box | Periscope | Clam |
| King | Periscope | Lifevest | Radar | Lifevest |
| Ace | Ace | Ace | Lifevest | Radar |
| Periscope | Jack | Captain | King | Ace |
| Scuba | Lifevest | Gold Box | Captain | Jack |
| Lifevest | Queen | Lifevest | Radar | Queen |
| Queen | Clam | Ace | Scuba | Periscope |
| King | Ace | Captain | Captain | King |
| Ace | King | Lifevest | Ace | Clam |
| Jack | Gold Box | King | Periscope | Lifevest |
| Gold Box | Periscope | Scuba | Radar | Captain |
| Periscope | Lifevest | Queen | Scuba | Periscope |
| Jack | Queen | Periscope | Queen | Jack |
| Lifevest | Radar | Radar | Lifevest | Scuba |
| Ace | Jack | Ace | Radar | Lifevest |
| Radar | Submarine | Captain | Captain | Periscope |
| Jack | King | Scuba | King | Radar |
| King | Queen | King | Scuba | Scuba |
| Periscope | Radar | Jack | Jack | Ace |
| Jack | Periscope | Lifevest | Radar | Radar |
| Queen | King | Queen | Captain | Periscope |
| Ace | Jack | Radar | Lifevest | Scuba |
| King | Scuba | Scuba | Periscope | Captain |
| Radar | Periscope | Lifevest | Captain | Radar |
| Jack | Queen | Ace | Queen | Lifevest |
| King | Scuba | Periscope | Radar | Ace |
| | | King | Scuba | Queen |
| | | Captain | Jack | King |
| | | Radar | Ace | Jack |
| | | Scuba | | |

FIG. 8

| THE NUMBER OF ACTIVATED PAYLINES | ADDITIONAL PAYOUT NUMBER |
|---|---|
| 25 | 500 |
| 20 | 400 |
| 9 | 180 |
| 5 | 100 |
| 1 | 20 |

FIG. 18

| ITEM OF TREASURE BOX | MULTIPLE NUMBER | THE NUMBER OF ARRANGEMENT | RANDOM NUMBER VALUE |
|---|---|---|---|
| DIAMOND | ×30 | 0 | 0~200 |
| | | 1 | 201~255 |
| GOLD | ×5 | 2 | 0~20 |
| | | 1 | 21~255 |

FIG. 22

| REEL5A | REEL5B | REEL5C | REEL5D | REEL5E |
|---|---|---|---|---|
| Queen | King | Periscope | Lifevest | Periscope |
| King | Scuba | Jack | Captain | Captain |
| Radar | Lifevest | King | Ace | Radar |
| Ace | Ace | Submarine | Submarine | Submarine |
| Submarine | Submarine | Jack | Periscope | Ace |
| King | Queen | Queen | Jack | Lifevest |
| Jack | Jack | Sawfish | Submarine | Submarine |
| Ace | Radar | Jack | Periscope | Captain |
| Submarine | Submarine | Radar | Queen | King |
| King | Queen | King | Clam | Submarine |
| Queen | Ace | Scuba | Scuba | Queen |
| Captain | Captain | Ace | Ace | King |
| Jack | King | King | King | Scuba |
| Ace | Jack | Periscope | Clam | Clam |
| Queen | Captain | Clam | Radar | Jack |
| King | Ace | Lifevest | Queen | King |
| Jack | Jack | Captain | Periscope | Clam |
| Clam | Submarine | | Lifevest | Jack |
| Queen | Ace | | Radar | Submarine |
| Jack | Queen | | Captain | Scuba |
| Scuba | Lifevest | | Jack | Queen |
| Queen | Jack | | Periscope | Periscope |
| King | King | | Radar | Lifevest |
| Captain | Captain | | Lifevest | Radar |
| Scuba | Queen | | King | Ace |
| Queen | Ace | | Captain | Clam |
| Lifevest | Lifevest | | Radar | Scuba |
| Ace | Jack | | Scuba | Periscope |
| Queen | Submarine | | Lifevest | Lifevest |
| Submarine | Ace | | Radar | Captain |
| King | Lifevest | | Scuba | Periscope |
| Jack | Radar | | Lifevest | Scuba |
| Periscope | Periscope | | Radar | Lifevest |
| Radar | Lifevest | | Captain | Periscope |
| Jack | Clam | | King | Queen |
| Ace | Queen | | Scuba | Scuba |
| Periscope | Radar | | Radar | Radar |
| Lifevest | King | | Captain | Periscope |
| Ace | Jack | | Periscope | Scuba |
| Radar | Queen | | Lifevest | Radar |
| Captain | Periscope | | Captain | Ace |
| Ace | King | | Radar | Lifevest |
| Queen | Lifevest | | Lifevest | King |
| Scuba | Queen | | Scuba | Queen |
| Ace | King | | Radar | Lifevest |
| Radar | Periscope | | Jack | Jack |
| Jack | Queen | | Captain | Periscope |
| Queen | Scuba | | Ace | Ace |
| Radar | Radar | | Queen | Captain |
| Periscope | Lifevest | | Scuba | Jack |

FIG. 25

| REEL5A | REEL5B | REEL5C | REEL5D | REEL5E |
|---|---|---|---|---|
| Queen | Radar | Periscope | Lifevest | Periscope |
| Radar | Periscope | Captain | Scuba | Captain |
| King | Scuba | Radar | Ace | Radar |
| Ace | Ace | Submarine | Submarine | Submarine |
| Submarine | Submarine | Queen | Periscope | Ace |
| Queen | Queen | Scuba | King | Lifevest |
| Captain | King | Gold Box | Submarine | Submarine |
| Captain | Radar | Jack | Periscope | King |
| Gold Box | Gold Box | Radar | Queen | Captain |
| King | Queen | Gold Box | Clam | Submarine |
| Scuba | Captain | Queen | Captain | Periscope |
| Ace | Ace | Captain | Ace | King |
| Captain | King | Gold Box | Captain | Scuba |
| Captain | Captain | King | Clam | Clam |
| Gold Box | Queen | Periscope | Radar | Queen |
| Queen | Ace | Clam | Queen | Scuba |
| Captain | Periscope | Ace | Periscope | Captain |
| Clam | Captain | Periscope | Lifevest | Clam |
| Queen | Ace | Clam | Radar | Periscope |
| Submarine | Periscope | Radar | Captain | Scuba |
| Scuba | King | Captain | Captain | Queen |
| Lifevest | Captain | Gold Box | Periscope | Clam |
| King | Periscope | Lifevest | Radar | Lifevest |
| Ace | Ace | Ace | Lifevest | Radar |
| Periscope | Captain | Captain | King | Ace |
| Scuba | Lifevest | Gold Box | Captain | Captain |
| Lifevest | Queen | Lifevest | Radar | Queen |
| Queen | Clam | Ace | Scuba | Periscope |
| King | Ace | Captain | Captain | King |
| Ace | King | Lifevest | Ace | Clam |
| Captain | Gold Box | King | Periscope | Lifevest |
| Gold Box | Periscope | Scuba | Radar | Captain |
| Periscope | Lifevest | Queen | Scuba | Periscope |
| Captain | Queen | Periscope | Queen | Captain |
| Lifevest | Radar | Radar | Lifevest | Scuba |
| Ace | Captain | Ace | Radar | Lifevest |
| Radar | Submarine | Captain | Captain | Periscope |
| Captain | King | Scuba | King | Radar |
| King | Queen | King | Scuba | Scuba |
| Periscope | Radar | Jack | Captain | Ace |
| Captain | Periscope | Lifevest | Radar | Radar |
| Queen | King | Queen | Captain | Periscope |
| Ace | Jack | Radar | Lifevest | Scuba |
| King | Scuba | Scuba | Periscope | Captain |
| Radar | Periscope | Lifevest | Captain | Radar |
| Jack | Queen | Ace | Queen | Lifevest |
| King | Scuba | Periscope | Radar | Ace |
| | | King | Scuba | Queen |
| | | Captain | Jack | King |
| | | Radar | Ace | Jack |
| | | Scuba | | |

FIG. 26

| REEL5A | REEL5B | REEL5C | REEL5D | REEL5E |
|---|---|---|---|---|
| Captain | Scuba | Captain | Lifevest | Queen |
| Radar | Ace | Jack | Captain | Clam |
| King | Radar | Lifevest | Clam | Lifevest |
| Jack | Periscope | Submarine | Captain | Radar |
| Captain | Submarine | Captain | Ace | Submarine |
| Queen | Queen | Scuba | Jack | King |
| Jack | King | Lifevest | Clam | Captain |
| Submarine | Radar | Jack | Radar | Ace |
| Gold Box | Ace | Captain | Queen | Jack |
| King | Queen | Gold Box | Periscope | Queen |
| Scuba | Captain | King | Radar | Periscope |
| Ace | Gold Box | Jack | Lifevest | King |
| Queen | King | Queen | King | Scuba |
| Ace | Captain | King | Submarine | Clam |
| Clam | Periscope | Periscope | Periscope | Queen |
| Queen | Periscope | Clam | Queen | Scuba |
| Captain | King | Ace | Periscope | Captain |
| Gold Box | Jack | Periscope | Lifevest | Clam |
| Queen | Ace | Clam | Radar | Periscope |
| Submarine | Queen | Radar | Captain | Scuba |
| Scuba | Jack | Periscope | Jack | Periscope |
| Lifevest | Ace | Gold Box | Submarine | Captain |
| King | Periscope | Radar | Periscope | Radar |
| Ace | Ace | Ace | King | Periscope |
| Periscope | Jack | Queen | Ace | King |
| Lifevest | Lifevest | Gold Box | Scuba | Ace |
| Scuba | Queen | Gold Box | Radar | Queen |
| Queen | Clam | Captain | Scuba | King |
| King | Ace | Scuba | Captain | Jack |
| Ace | King | King | Ace | Clam |
| Jack | Gold Box | Jack | Periscope | Lifevest |
| Gold Box | Periscope | Lifevest | Radar | Captain |
| Periscope | King | Queen | Scuba | Periscope |
| Jack | Submarine | Radar | Jack | Jack |
| Lifevest | King | Ace | Radar | Scuba |
| Ace | Queen | Radar | Captain | Lifevest |
| Jack | Radar | Lifevest | Queen | Periscope |
| Radar | Periscope | Queen | Scuba | Radar |
| King | King | Scuba | Queen | Scuba |
| Periscope | Jack | Gold Box | Lifevest | Ace |
| Jack | Scuba | Scuba | Radar | Radar |
| Ace | Periscope | Lifevest | Captain | Captain |
| Queen | Queen | Ace | King | Submarine |
| King | Scuba | Periscope | Captain | Captain |
| King | Lifevest | Radar | Lifevest | Radar |
| Jack | Queen | Scuba | Periscope | Lifevest |
| Radar | Radar | Periscope | Radar | Ace |
| | | King | Scuba | Lifevest |
| | | Ace | Jack | Submarine |
| | | Radar | Ace | King |
| | | Captain | | |

GAMING MACHINE AND GAMING METHOD THEREOF

CROSS-REFERENCE TO RELATED APPLICATIONS

This application is based upon and claims a priority from the prior Japanese Patent Application No. 2006-337425 filed on Dec. 14, 2006, the entire contents of which are incorporated herein by reference.

BACKGROUND

1. Field

One or more aspects of the invention relate to a gaming machine and a gaming method thereof in which display area of symbols can be designated as areas to be used for a determination of a winning.

2. Description of Related Art

Conventionally, plural reels having plural symbols are used to display a game result, regardless of mechanical slot machines or video slot machines. The symbols are variably displayed in accordance with spinning reels, and then, reels are stopped based on an internal lottery result. Areas, where the symbols are displayed, are predefined. Also, it is determined whether or not the winning is realized based on the combination of displayed symbols on the predefined areas. According to the result, if it is determined that the winning combination is realized, the payout is provided based on the winning combination and the bet number for the predefined area.

In conventional slot machines located at casinos or the like, when the game is started, a player designates the areas for the determination of the winning among plural areas. Also, the bet number per area is set, and total bet number per one game is set based on the number of the designated areas and the bet number per area.

Here, various unit values are set in various slot machines. For example, some slot machine define that the unit value per one bet is 1 dollar. Also, some slot machine define that the unit value per one bet is 5 cents. Total bet amount is determined by multiplying the unit value by the total bet number.

Recently, many casinos tend to arrange slot machines, in which more areas can be designated, so that the player can obtain various winning combination of the symbols. In above slot machine, higher total bet number may be set based on the designated areas and bet number per designated area.

Here, if the winning combination occurs on any of the designated areas, the payout number is based on the bet number per bet, but the total bet number. Herewith, the player may not obtain commensurate payout number of the total bet number. At a result, motivation of the player for designating more areas may drop, and it may be difficult to increase the total bet number.

SUMMARY

One or more aspects invention related to a gaming machine, a gaming method thereof, a computer readable medium having computer-executable instructions or the like which nonconventional gaming environment.

Also, in a base game, one or more paylines to be activated and a bet number for the activated paylines are set. If a combination of displayed symbols on the activated payline is a winning combination, an outcome amount is calculated by multiplying a payout number corresponding to the realized winning combination by the bet number, and the calculated outcome amount will be provided to the player. Also, a payout number corresponding to the number of the activated paylines will be additionally provided to the player.

One or more of the above aspects of the invention will be more fully described in the following detailed description when read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

FIG. 4 is view schematically showing symbol column displayed on surfaces of each reel used in a base game in accordance with one or more aspects of the present invention.

FIG. 8 is a payout table of the number of activated paylines and payout numbers thereof in the base game in accordance with one or more aspects of the present invention.

FIG. 18 is a lottery table of alignments of items in treasure boxes in a selection game in accordance with one or more aspects of the present invention.

FIG. 22 is view schematically showing symbol column displayed on surfaces of each reel used in a free game in accordance with one or more aspects of the present invention.

FIG. 25 is view schematically showing symbol column displayed on surfaces of each reel used in the base game in accordance with one or more aspects of the present invention.

FIG. 26 is view schematically showing symbol column displayed on surfaces of each reel used in the base game in accordance with one or more aspects of the present invention.

DETAILED DESCRIPTION

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine according to one or more aspects of the invention will be described in detail with reference to the drawings based on an embodiment embodying one or more aspects of the invention as a card game machine. However, it is appreciated that one or more aspects of the present invention may be embodied in distributable (via CD and the like) or downloadable software games, console games, and the like. In this regard, the slot machine may be a virtual slot machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU" and "processor" are inclusive by nature, including at least one of hardware, software, or firmware.

These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server. It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

Figure 1:
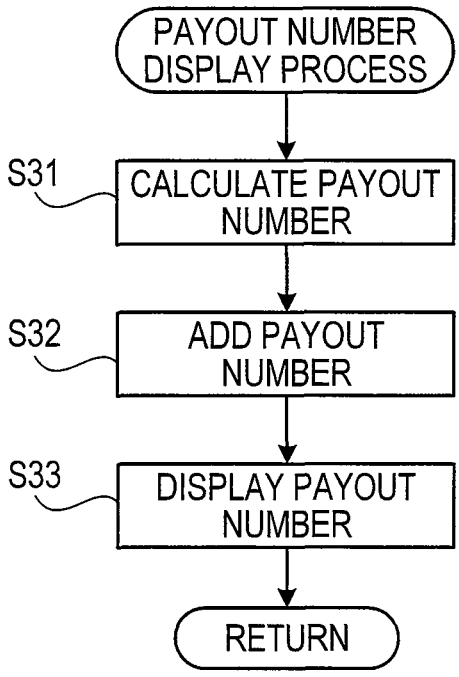
FIG. 1 is a feature of a slot machine and a flowchart of a payout number display process program in accordance with one or more aspects of the present invention.

FIG. 1 shows a feature of a base game (slot game) executed in a slot machine of an embodiment embodying one or more aspects present invention. FIG. 1 shows a flowchart of a payout number display process.

In the base game (slot game) executed in the slot machine of the embodiment, at first, paylines to be activated are set among twenty five paylines, and the bet number per the activated payline is set. If it is determined that the combination of the symbols displayed on one activated payline is a winning combination, the payout number corresponding to the winning combination is multiplied by the bet number of corresponding to the activated payline (S31). The multiplied payout number will be provided to the player. And then, the payout number corresponding to the number of the activated number is added to the payout number to be provided to the player (S32).

In a modified base game (slot game) executed the slot machine of the embodiment, if all of twenty five paylines are activated, construction of symbol columns arranged on surface of the video reel displayed on the video display may be changed, and lottery setting to determine symbols to be stopped on the payline may be changed.

The embodiment embodying one or more aspects of the invention as the slot machine will be described in detail with the reference drawings below.

Figure 2:
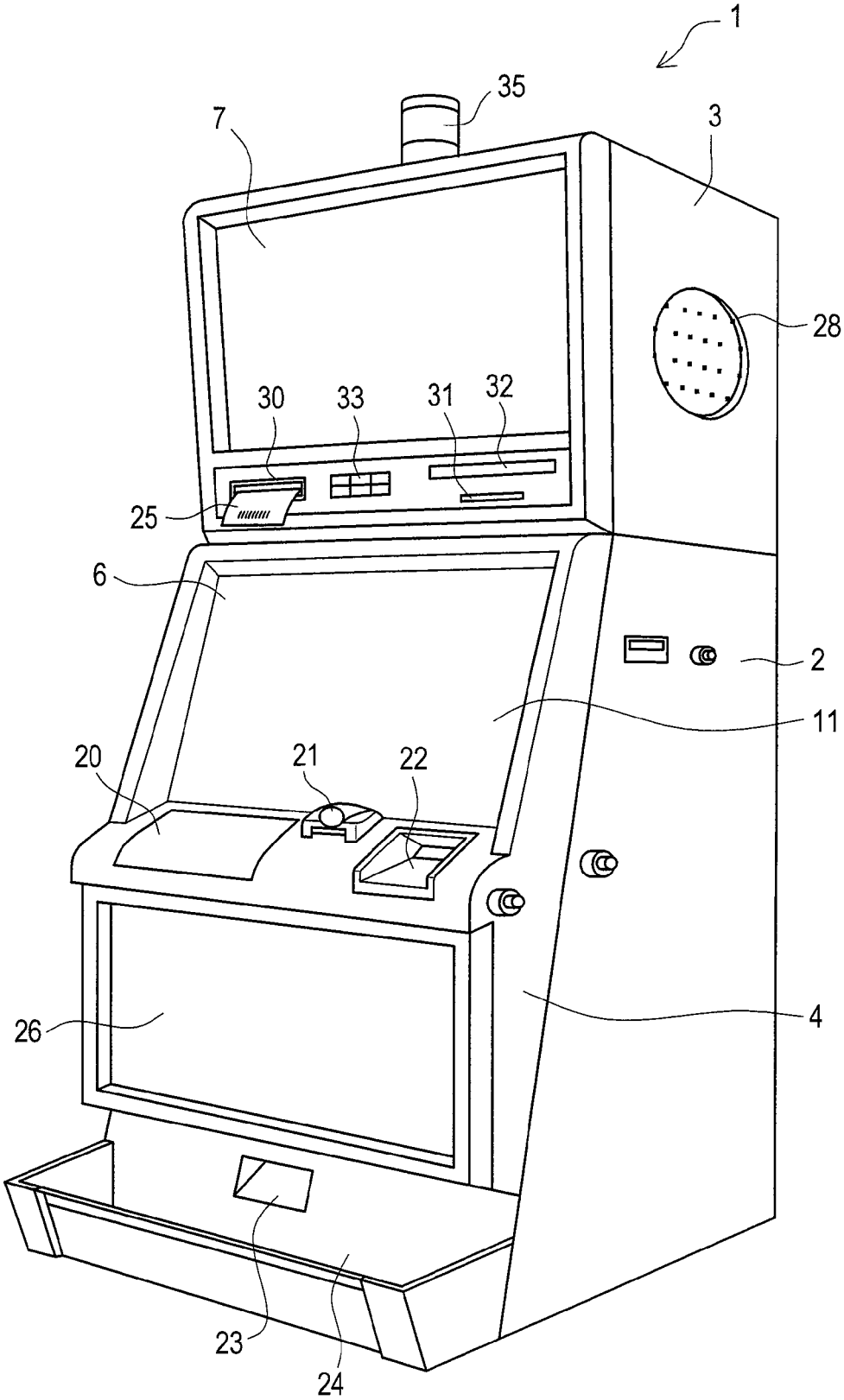
FIG. 2 is a perspective view showing the slot machine in accordance with one or more aspects of the present invention.

At first, a construction of the slot machine 1 of the embodiment embodying one or more aspects of the invention will be described with reference to FIG. 2. FIG. 2 is a perspective view showing the slot machine of the embodiment.

The slot machine 1 may include a cabinet 2, a top box 3, and a main door 4. The top box 3 is arranged on the cabinet 2 (for instance, arranged on upper side). The main door 4 is arranged at front of the cabinet 2.

An upper image display panel 7 may be arranged with the slot machine 1 (for example, arranged in front of the top box 3). The upper image display panel 7 may include the display device (for example, LCD panel). Gaming information such as demonstration image, the game rule, the payout table, or the like may be displayed on the upper image display panel 7.

A lower image display panel 6 may be arranged with the slot machine 1 (for example, arranged in front of the main door 4).

Figure 10:
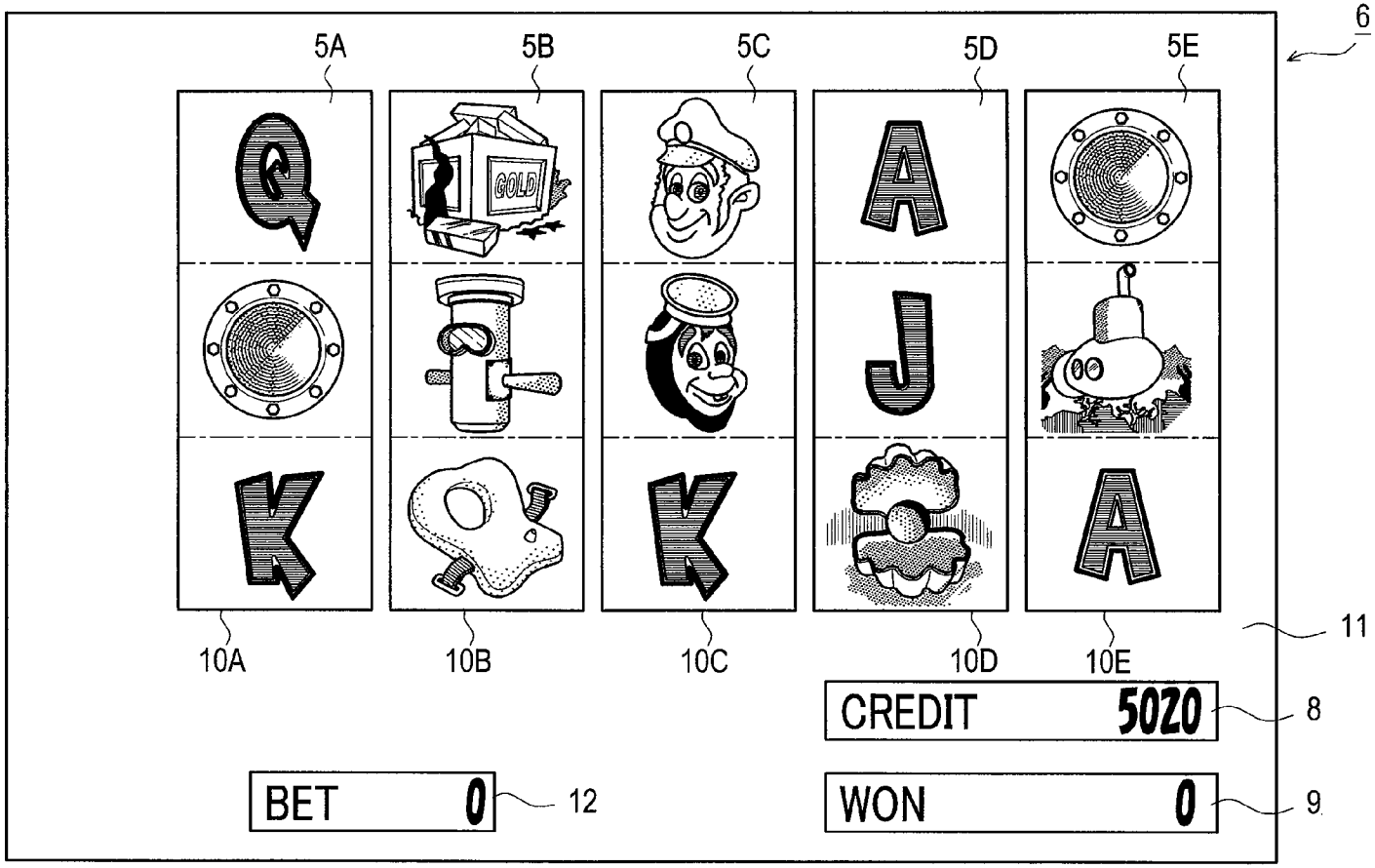
FIG. 10 is a view showing display content displayed on the lower image display panel in accordance with one or more aspects of the present invention.
Figure 11:
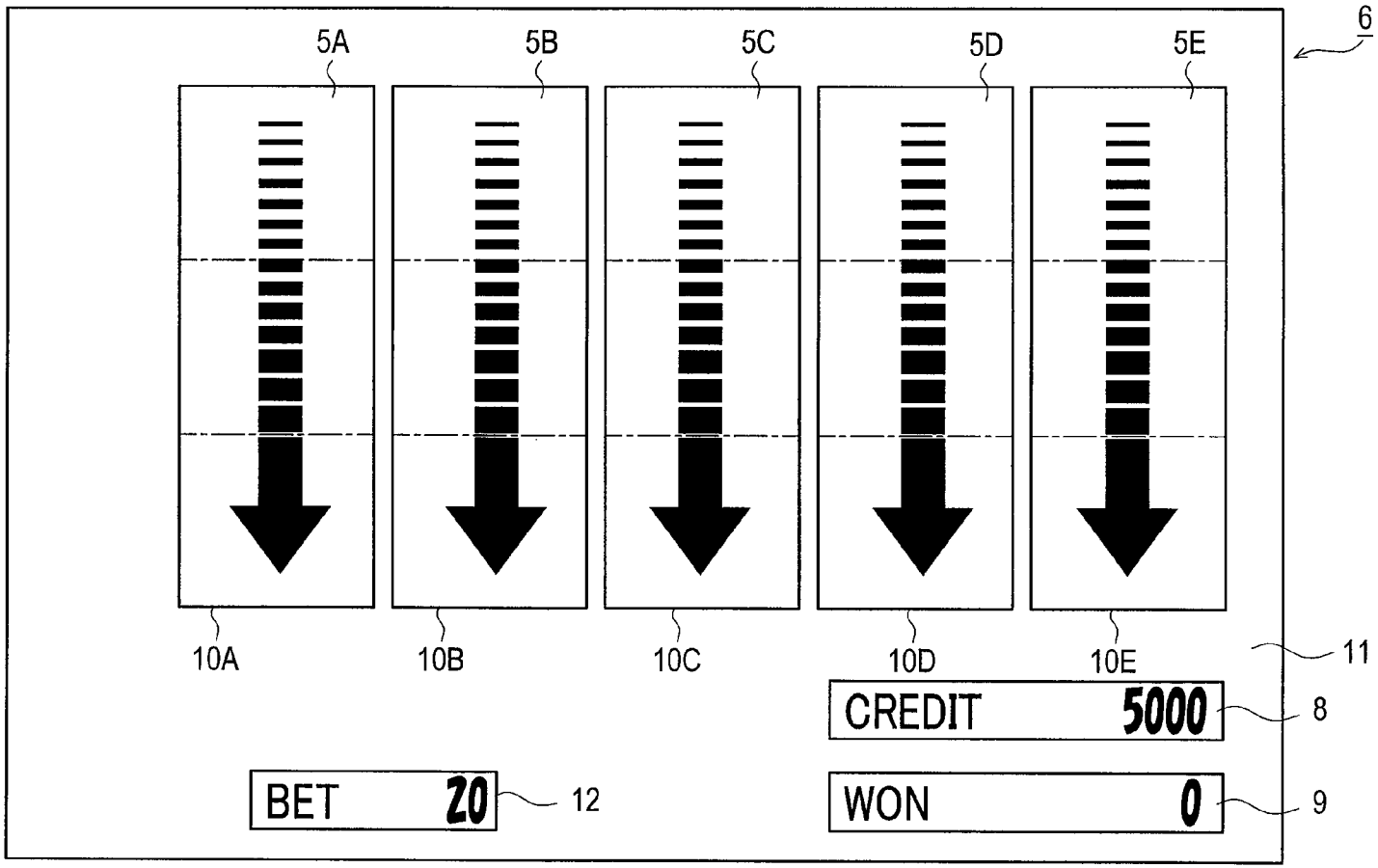
FIG. 11 is a view showing display content displayed on the lower image display panel in accordance with one or more aspects of the present invention.
Figure 12:
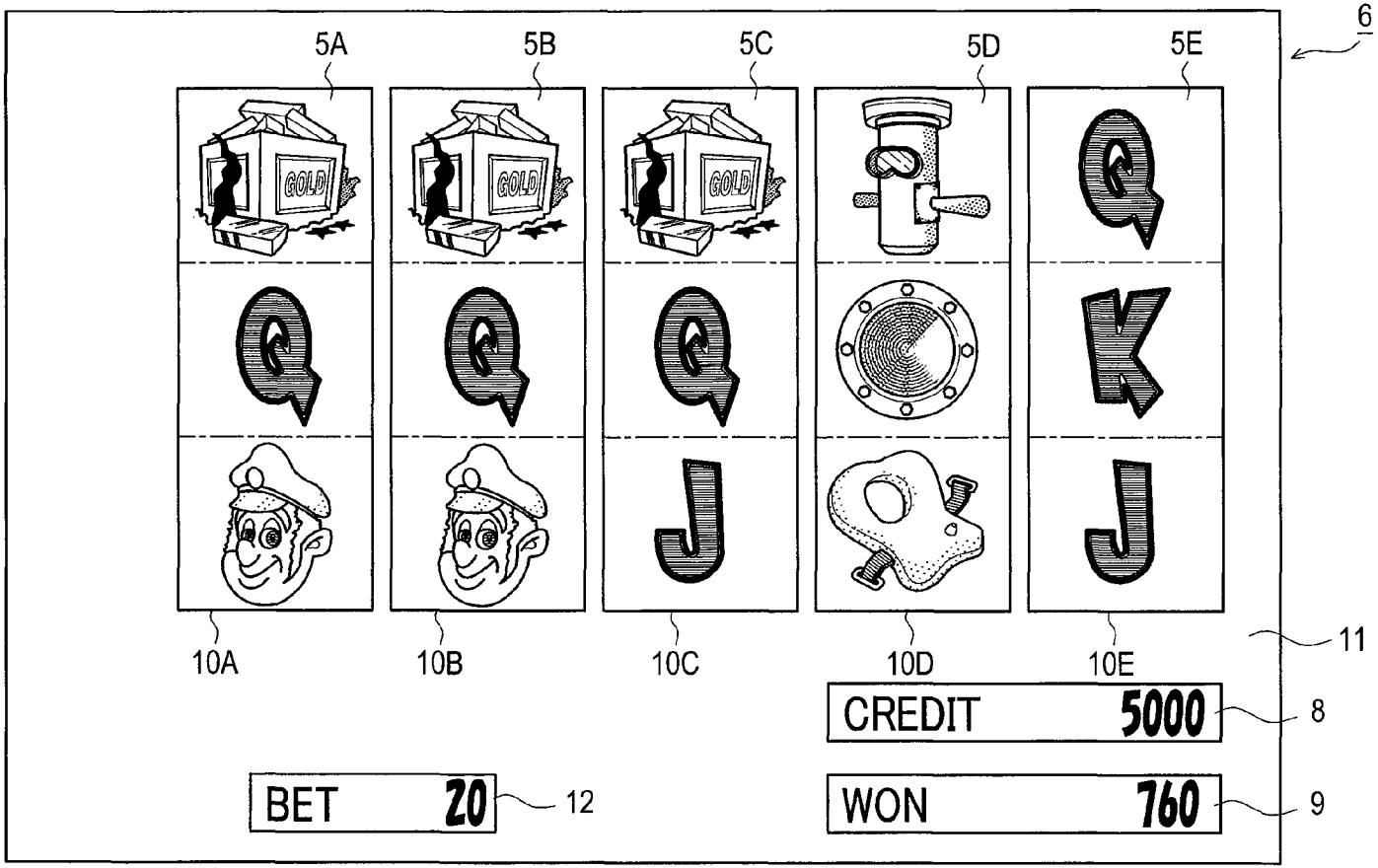
FIG. 12 is a view showing display content displayed on the lower image display panel in accordance with one or more aspects of the present invention.

Images of the game in the slot machine 1 displayed on the lower image display panel 6 will be described. FIGS. 9 to 12 are sample contents displayed on the lower image panel 6. In the based game, as shown in FIGS. 10 and 12, the symbols displayed on the outer surface of the each video reel 5A, 5B, 5C, 5D, and 5E are visible on the each display window 10A, 10B, 10C, 10E, and 10E on the lower image display panel 6. FIGS. 10 and 12 show a condition that the symbols displayed on the outer surface of each video reel 5A, 5B, 5C, 5D, and 5E are arranged or repositioned. FIG. 11 shows a condition that the symbols display on the outer surface of each video reel 5A, 5B, 5C, 5D, and 5E are spin on each of the display windows 10A, 10B, 10C, 10D, and 10E.

Five display windows 10A, 10B, 10C, 10D, and 10E are displayed on the lower image display panel 6. Each of three symbols displayed on the outer surface of each of reels 5A, 5B, 5C, 5D, and 5E via the display windows 10A, 10B, 10C, 10D, and 10E.

Here, symbol columns (see FIG. 4) including plural symbols are displayed on each outer surface of five video reels 5A, 5B, 5C, 5D, and 5E.

The touch panel 11 may be arranged in front of the lower image display panel 6. The player can input various instructions by operating the touch panel 11.

The credit number display portion 8, the payout number display portion 9, and bet number display portion 12 are arranged on the lower image display panel 6. The credit number in which the player currently owns may be displayed on the credit number display portion 8. The payout number obtained in the base game (slot game) and the bonus game (free game or selection game) may be displayed on the payout number display portion 9. The bet number in which the player currently bets in the unit game of the base game may be displayed on the bet number display portion 12.

Figure 9:
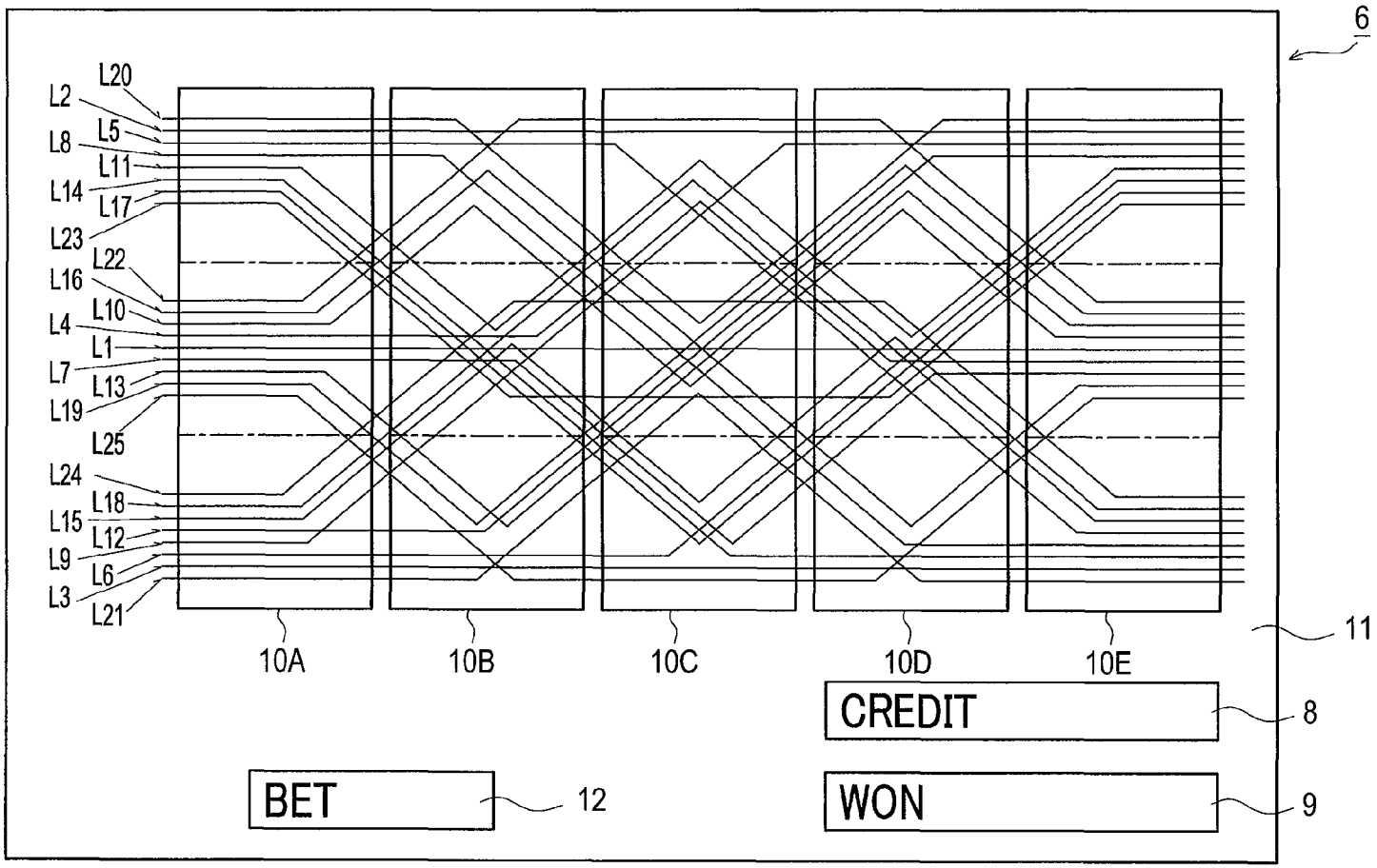
FIG. 9 is a view showing display content displayed on the lower image display panel in accordance with one or more aspects of the present invention.

Also, each of twenty five paylines L1 to L25 crosses five display windows 10A, 10B, 10C, 10D, and 10E, as shown in FIG. 9. Each of twenty five paylines L1 to L25 defines five symbols making up one winning combination.

Here, in the base game and the bonus game, only activated paylines among twenty five paylines L1 to L25 are visible. Also, in the selection game, predetermined bonus screen, in which the display windows 10A, 10B, 10C, 10D, and 10E (including each of the reels 5A, 5B, 5C, 5D, and 5E) and each of the paylines L1 to L25 are erased, are displayed with the payout number display portion 9 or the like (see FIGS. 17, 19, 20, and 23).

Returning FIG. 2, a control panel 20 is arranged at the image display panel 6 (for example, arranged on lower side). Buttons are arranged at the control panel 20. The buttons are the buttons to input the instructions for gaming session by the player. A coin slot 21 and a bill verifier 22 can be arranged in relation to the image display panel 6 (for example, arranged on lower side). The coin slot 21 may receive the gaming medium into the cabinet 2.

Figure 3:
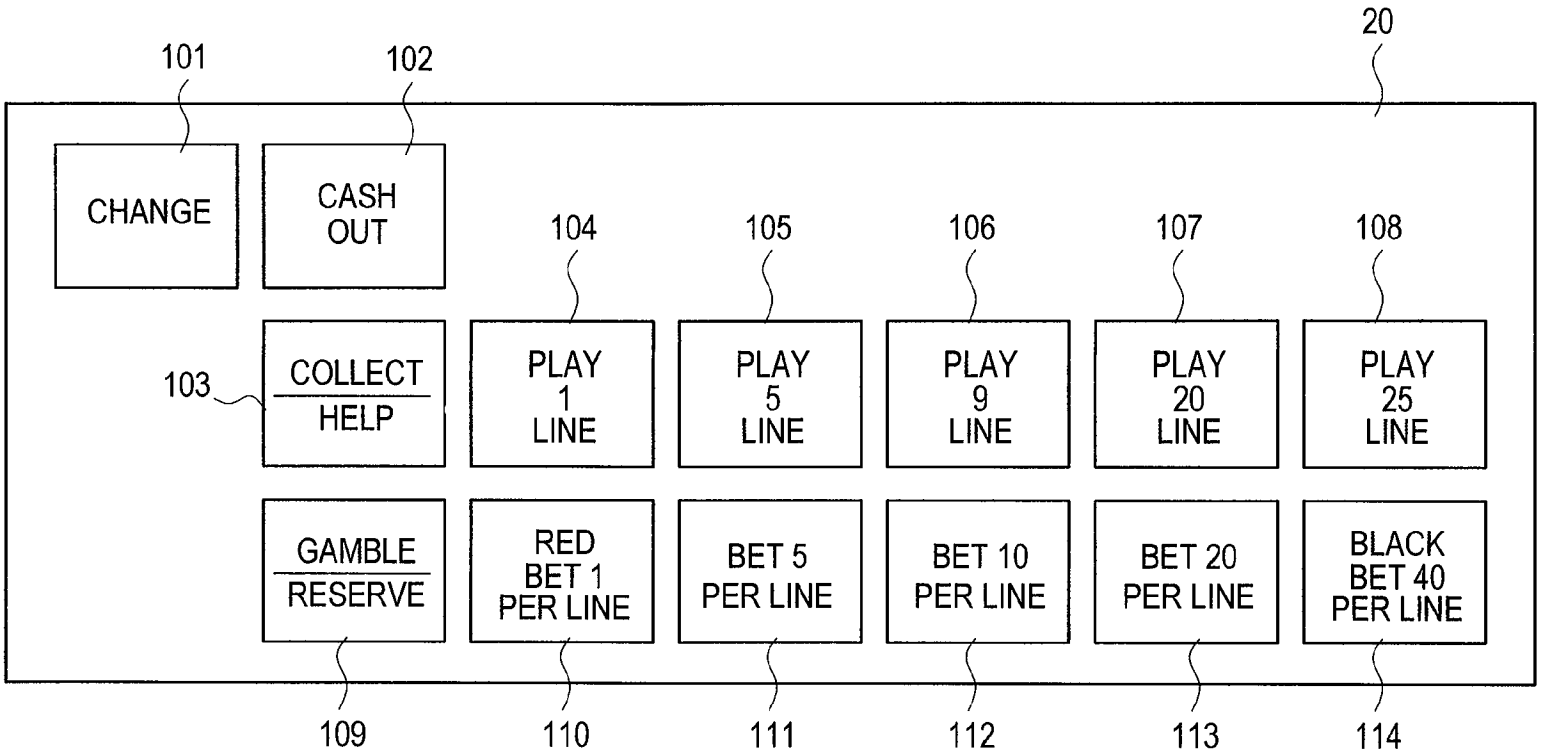
FIG. 3 is a front view showing a control panel in accordance with one or more aspects of the present invention.

The control panel 20 will be described. FIG. 3 shows a front view of the control panel 20. As shown in FIG. 3, a CHANGE button 101, a CHASHOUT button 102 are arranged from the left on upper stage of the control panel 20. A COLLECT/HELP button 103, a PLAY 1 LINE button 104, a PLAY 5 LINE button 105, a PLAY 9 LINE button 106, a PLAY 20 LINE button 107, and a PLAY 25 LINE button 108 are arranged on middle stage of the control panel 20 from the left. A GAMBLE/RESERVE button 109, a RED BET 1 PER LINE button 110, a BET 5 PER LINE button 111, a BET 10 PER LINE button 112, a BET 20 PER LINE button 113, and a BLACK BET 40 PER LINE 114 are arranged on lower stage of the control panel 20 from the left.

The CHANGE button 101 exchanges the bill inserted on the bill verifier 22 (see FIG. 2). The exchanged coins may be paid through a coin payout opening 23 (see FIG. 2) to a coin tray 24 (see FIG. 2). Here, the coin payout opening 23 is arranged on the lower portion of the cabinet (see FIG. 2).

The CASHOUT button 102 is pressed when the coins, corresponding to the credit number in which the player currently owns (for example, one credit is equal to one coin), are paid out from the coin opening 23 (see FIG. 2) to the coin tray 24 (see FIG. 2), or the barcode ticket 25 (see FIG. 2) with the barcode is paid out.

The COLLECT/HELP button 103 used when the DOUBLE DOWN game, which is executed with the use of the payout number obtained in the bonus game, is finished or the player wants to know manner of the game. Here, if the COLLECT/HELP button 103 is operated and the DOUBLE DOWN game is finished, the payout number, which is increased or decreased, will be added to the credit number which is the player currently owns.

The PLAY 1 LINE button 104 is used when the player activates a payline L1. When the PLAY 1 LINE button 104 is pressed, the number of the activated paylines is 1.

The PLAY 5 LINE button 105 is used when the player activates a paylines L1 to L5. When the PLAY 5 LINE button 105 is pressed, the number of the activated paylines is 5.

The PLAY 9 LINE button 106 is used when the player activates a paylines L1 to L9. When the PLAY 9 LINE button 106 is pressed, the number of the activated paylines is 9.

The PLAY 20 LINE button 107 is used when the player activates a paylines L1 to L20. When the PLAY 20 LINE button 107 is pressed, the number of the activated paylines is 20.

The PLAY 25 LINE button 108 is used when the player activates a paylines L1 to L25. When the PLAY 25 LINE button 108 is pressed, the number of the activated paylines is 25.

The GAMBLE/RESEVE button 109 is used when the DOUBLE DOWN game is executed after the bonus game is finished or the player leaves a seat.

The RED BET 1 PER LINE button 110 is used when the player sets bet number "1" per payline L.

The BET 5 PER LINE button 111 is used when the player sets bet number "5" per payline L.

The BET 10 PER LINE button 112 is used when the player sets bet number "10" per payline L.

The BET 20 PER LINE button 113 is used when the player sets bet number "20" per payline L.

The BLACK BET 40 PER LINE button 114 is used when the player sets bet number "40" per payline L.

Also, the RED BET 1 PER LINE button 110 and the BLACK BET 40 PER LINE button 114 are used when the player selects RED or BLACK in the DOUBLE DOWN game.

Returning FIG. 2, a coin verifier 21S (see FIG. 6) and a coin counter 21C (see FIG. 6) are arranged inside of the coin slot 21. The coin verifier 21S (see FIG. 6) verifies the coin inserted from the coin slot 21, and the fake coins may be discharged through the coin payout opening 23. The coin counter 21C (see FIG. 6) detects received qualified coin and counts the number of the coins.

The bill verifier 22 verifies the bill and receives qualified bill into cabinet 2. The bill which is received into cabinet 2 is converted to the coin count, and the credit count corresponding to the converted coin count may be added to the owned credit count of the player. The bill verifier 22 can read a ticket 25 with the barcode (which will be described later). A panel 26 is arranged on the main door 4 (for example, arranged on lower side, namely arranged below the control panel 20). Characters of the slot machine 1 may be displayed on the panel 26.

In the slot machine 1 of the embodiment, the gaming medium may be coin, bill, or electronic value (credit). Here, the gaming medium may be other things as well (including but not limited to medal, token, electronic money, or ticket).

A ticket printer 30, a card reader 31, a data display 32, and a keypad 33 are arranged at the upper image display panel 7 (for example, arranged on lower side).

The ticket printer 30 prints the ticket with the bar code in which the data (such as credit count, date, or ID number of the slot machine 1) may be coded. The printed ticket is the ticket 25. When the ticket 25 is scanned by other gaming machines, the player will be able to play the other gaming machines or be able to go through some procedure in some place.

The card reader 31 reads from the storage medium (for example, smart card) and writes the storage medium (for example, smart card). The player owns the storage medium, and the gaming record of the player is stored in the storage medium.

The data (which is read by the card reader 31 or input data which is input by the player via the keypad 33) may be displayed on the data display 32. The keypad 33 may be used when the player input the instruction or the data related to the print the ticket (for example).

A lamp 35 is arranged at the top box 3 (for example, arranged on top). The lamp 35 may turn on with predetermined pattern when the player wants call the clerk of the game hall when the slot machine 1 has errors (for example).

Here, loudspeaker 28 may be arranged.

Figure 5:
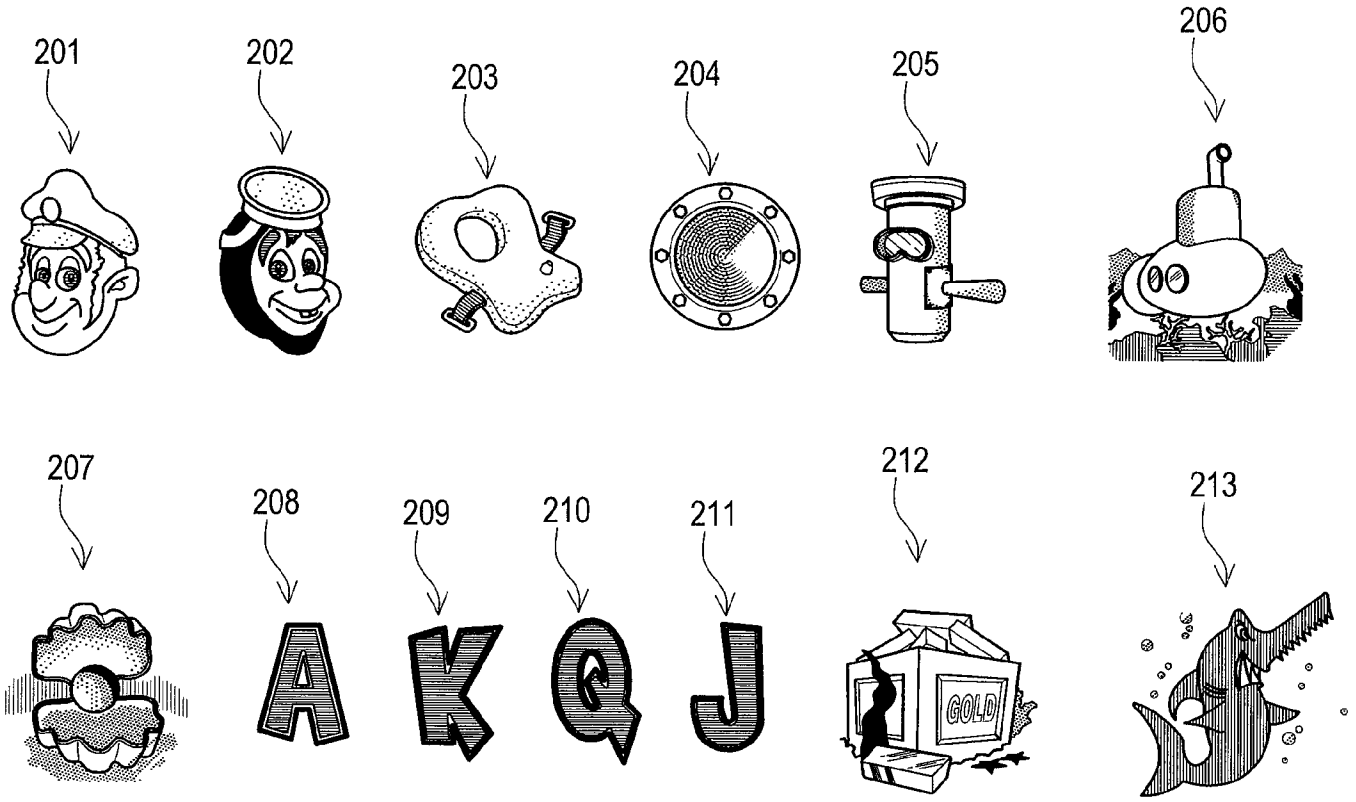
FIG. 5 is symbols displayed the surfaces of each reel in accordance with one or more aspects of the present invention.

The symbols will be described with reference to FIGS. 4 and 5. The symbols are displayed on the outer surface of the each video reel 5A, 5B, 5C, 5D, and 5E repositioned with scroll via the each display window 10A, 10B, 10C, 10D, and 10E of the lower image display panel 6 in the base game and the free game. FIG. 4 is a view schematically showing the symbols displayed on the outer surface of each reel 5A, 5B, 5C, 5D, and 5E in the base game. FIG. 5 shows symbols displayed on the outer surface of the each of the reels 5A, 5B, 5C, 5D, and 5E.

On the outer surface of the each reel 5A, 5B, 5C, 5D, and 5E, symbols may be displayed with predetermined number. Here, on the outer surface of the reels 5A, and 5B, forty seven symbols are displayed respectively (for example). On the outer surface of the reel 5C, fifty one symbols are displayed (for example). On the outer surface of the reel 5D, and 5E, fifty symbols are displayed respectively (for example).

As shown in FIG. 5, each of symbol columns includes "Captain" symbol 201, "Scuba" symbol 202, "Lifevest" symbol 203, "Radar" symbol 204, "Periscope" symbol 205, "Submarine" symbol 206, "Clam" symbol 207, "Ace" symbol 208, "King" symbol 209, "Queen" symbol 210, "Jack" symbol 211, and "Gold Box" symbol 212. Here, "Sawfish" symbol 213 is not used.

As shown in FIG. 4, many kinds of symbols are positioned on the outer surface of each of reels 5A, 5B, 5C, 5D, and 5E in predetermined order.

The symbol columns shown in FIG. 4 are used in the base game. In the free game, different symbol column is used. FIG. 22 shows symbol columns displayed on each of the reels 5A, 5B, 5C, 5D, and 5E used in the free game.

On the outer surface of the reels 5A, 5B, 5C, 5D, and 5E using in the free game, symbols are displayed with predetermined number. On the outer surface of the reel 5A, 5B, 5D, and 5E, fifty symbols are displayed respectively (for example). On the outer surface of the reel 5C, seventeen symbols are displayed (for example).

As shown in FIG. 5, each of symbol columns includes "Captain" symbol 201, "Scuba" symbol 202, "Lifevest" symbol 203, "Radar" symbol 204, "Periscope" symbol 205, "Submarine" symbol 206, "Clam" symbol 207, "Ace" symbol 208, "King" symbol 209, "Queen" symbol 210, "Jack" symbol 211, and "Sawfish" symbol 213. Here, "Gold Box" symbol 212 is not used.

As shown in FIG. 22, plural symbols are positioned with predetermined order on the outer surface on each of the reels of 5A, 5B, 5C, 5D, and 5E.

Figure 7:
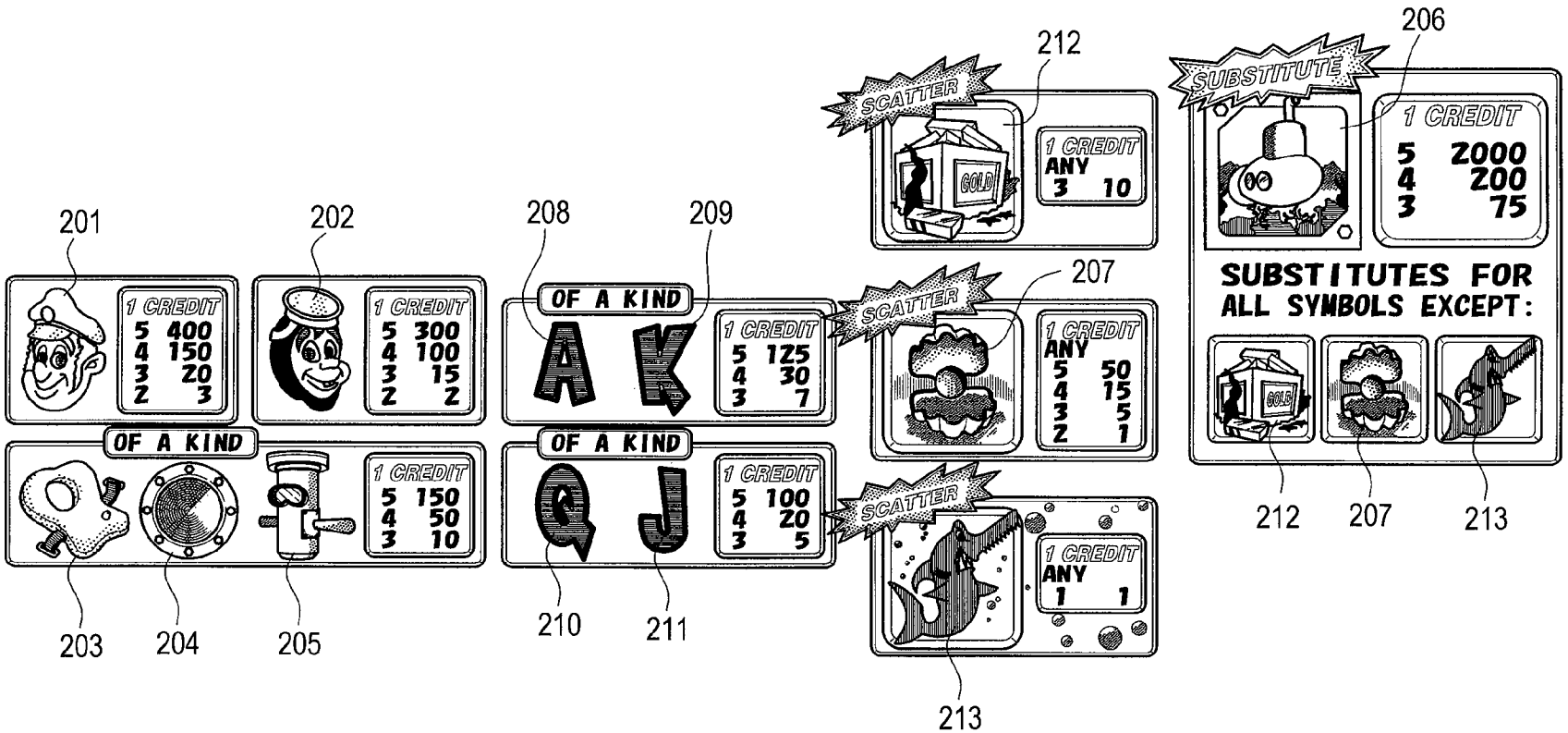
FIG. 7 is a payout table of winning combinations and payout numbers thereof in the base game and a bonus game in accordance with one or more aspects of the present invention.

In the base game and the bonus game, if the "Captain" symbols 201, the "Scuba" symbols 202, the "Lifevest" symbols 203, the "Radar" symbols 204, the "Periscope" symbols 205, the "Submarine" symbols 206, the "Ace" symbols 208, the "King" symbols 209, the "Queen" symbols 210, or the "Jack" symbols 211 are repositioned with predetermined number on each of the activated paylines any of L1 to L25 of the lower image display panel 6, predetermined payout number will be provided to the player (see FIG. 7).

The "Clam" symbol 207 and the "Sawfish" symbol 213 are scatter symbols. If the "Clam" symbols 207 or the "Sawfish" symbols 213 are repositioned with predetermined number on the lower image display panel 6 regardless of whether being displayed on each of the activated paylines any of L1 to L25, predetermined payout number will be provided to the player (see FIG. 7).

The "Submarine" symbol 206 is a wild symbol. The "Submarine" symbol 206 is used to substitute for other than the scatter symbols (the "Clam" symbol 207, the "Sawfish" symbol 213) (see FIG. 7). If the "Submarine" symbol 206 is repositioned on each of the activated paylines L1 to L25 of the lower image display panel 6, predetermined payout number will be provided to the player (see FIG. 7).

The "Gold Box" symbol 212 is a trigger symbol. If each one "Gold Box" symbols 212 is displayed in each of display windows 10A, 10B and 10C via the each of the reel 5A, 5B, and 5C (namely, three "Gold Box" are repositioned) regardless of whether being repositioned each of the paylines L1 to L25 on the lower image display panel 6, the predetermined payout number will be provided to the player and the procedure will be shifted the free game from the base game. FIG. 12 shows an example where each one "Gold Box" symbols 212 is displayed in each of display windows 10A, 10B, and 10C via each of the reels 5A, 5B, and 5C (namely, three "Gold Box" symbols 212 are repositioned) regardless of whether being repositioned each of the paylines L1 to L25 on the lower image display panel 6.

Also, If each one "Gold Box" symbols 212 is displayed in each of display windows 10A and 10B via the each of the reel 5A and 5B (namely, two "Gold Box" symbols 212 are repositioned) regardless of whether being repositioned each of the paylines L1 to L25 on the lower image display panel 6, the procedure will be shifted the free game from the base game.

If the "Sawfish" symbol 213 is displayed on the reel 5C regardless of whether being repositioned each of the paylines L1 to L25 on the lower image display panel 6, the number of occurrences of trigger event is counted up. Here, if the number of occurrence of trigger event reaches three, the procedure will be shifted to the base game from the free game.

Here, each of the symbols making up the symbol columns shown in FIG. 4 is allotted code number from the top. In the same manner as that, the symbol columns shown in FIG. 22 are allotted code number.

The games executed in the slot machine 1 of the embodiment include the base game and the bonus game.

In the base game, the slot games, in which the symbols are repositioned on the activated payline via each of the reels 5A, 5B, 5C, 5D, and 5E, and the symbol combination is displayed on the lower image display panel 6, are executed.

A part of the symbol columns displayed on outer surface of the each video reel 5A, 5B, 5C, 5D, and 5E are displayed in the display windows 10A, 10B, 10C, 10D, and 10E. Therefore, each three symbols are displayed in the display windows 10A, 10B, 10C, 10D, and 10E, so total of fifteen symbols are repositioned.

Also, if the bet number and the number of activated paylines are set by operating each of the buttons 104 to 108, and 110 to 114 arranged on the control panel 20, the reels 5A, 5B, 5C, 5D, and 5E are spun. Thereby, the symbol columns displayed on outer surface of each video reel 5A, 5B, 5C, 5D, and 5E are scrolled display from the top to the bottom (see FIG. 11) on each of the display windows 10A, 10B, 10C, 10D, and 10E.

When the predetermine time is elapsed, the reels 5A, 5B, 5C, 5D, and 5E shown in FIG. 4 are stopped. Thereby, the part of the symbol columns displayed on outer surface of the reels 5A, 5B, 5C, 5D, and 5E are displayed on the display windows 10A, 10B, 10C, 10D, and 10E. Accordingly, each of three symbols are repositioned on display windows 10A, 10B, 10C, 10D, and 10E, so total of fifteen symbols are repositioned (see FIG. 10).

Various winning combinations (see FIG. 7) are defined based on the combinations of the symbols. If the combination of displayed symbols on the activated payline L on the lower image display panel 6 is any of winning combinations, the outcome amount is calculated by multiplying the payout number corresponding to the winning combination by the bet number, and the calculated outcome amount will be provided to the player.

Also, if the winning combination is realized with the scatter symbol, the outcome amount is calculated by multiplying the payout number corresponding to the winning combination by the bet number. And then, the calculated outcome amount will be provided to the player.

Here, if plural winning combinations are realized, the outcome amount calculated by multiplying sum of each payout number by the bet number will be provided.

In the base game, if the combination of the symbols displayed on the activated payline L on the lower image panel 6 is any of the winning combination, the payout number corresponding to the number of the activated paylines will be additionally provided to the player (see FIG. 8).

The bonus game includes the free game and the selection game.

In the free game, in the same manner as the base game, the slot games, in which the symbols are repositioned on the activated paylines via each of the reels 5A, 5B, 5C, 5D, and 5E on the lower image display panel 6, are executed. Here, in the free game, the bet number and the number of the activated payline, which are set in the latest unit game of the base game which precedes the free game, are set and the game will be executed twenty times (at maximum) without betting the coins or the like.

A part of the symbol columns displayed on outer surface of the each video reel 5A, 5B, 5C, 5D, and 5E shown in FIG. 22 are displayed in the display windows 10A, 10B, 10C, 10D, and 10E. Thereby, each three symbols are displayed in the display windows 10A, 10B, 10C, 10D, and 10E, so total of fifteen symbols are repositioned.

The reels 5A, 5B, 5C, 5D, and 5E are spun. Thereby, the symbol columns displayed on outer surface of each reel 5A, 5B, 5C, 5D, and 5E are scrolled display from the top to the bottom (see FIG. 11) on each of the display windows 10A, 10B, 10C, 10D, and 10E.

When the predetermine time is elapsed, the video reels 5A, 5B, 5C, 5D, and 5E shown in FIG. 22 are stopped. Thereby, the part of the symbol columns displayed on outer surface of the video reels 5A, 5B, 5C, 5D, and 5E are displayed on the display windows 10A, 10B, 10C, 10D, and 10E. Accordingly, each of three symbols are repositioned on display windows 10A, 10B, 10C, 10D, and 10E, so total of fifteen symbols are repositioned (see FIG. 10).

Various winning combinations (see FIG. 7) are defined based on the combinations of the symbols. If the combination of displayed symbols on the activated payline L on the lower image display panel 6 is any of winning combinations, the outcome amount is calculated by multiplying the payout number corresponding to the winning combination by the bet number, and the calculated outcome amount will be provided to the player.

Also, if the winning combination is realized with the scatter symbol, the outcome amount is calculated by multiplying the payout number corresponding to the winning combination by the bet number. And then, the calculated outcome amount will be provided to the player.

Here, if plural winning combinations are realized, the outcome amount calculated by multiplying sum of each payout number by the bet number will be provided.

In the free game, as mentioned above, if the "Sawfish" symbol 213 is repositioned the window display 10C via the reel 5C on the lower image display panel 6 regardless of whether being repositioned on each of the paylines L1 to L25, the number of occurrences of trigger event is counted up. Also, if the number of occurrence of trigger event reaches three, the free game will be executed even though the number of the executed free games does not reach twenty.

On the other hand, in the free game, if the game is continuously executed with twenty times (at maximum), the outcome amount calculated by multiplying the bet number by the forty will be additionally provided to the player when the free game is finished.

Figure 23:
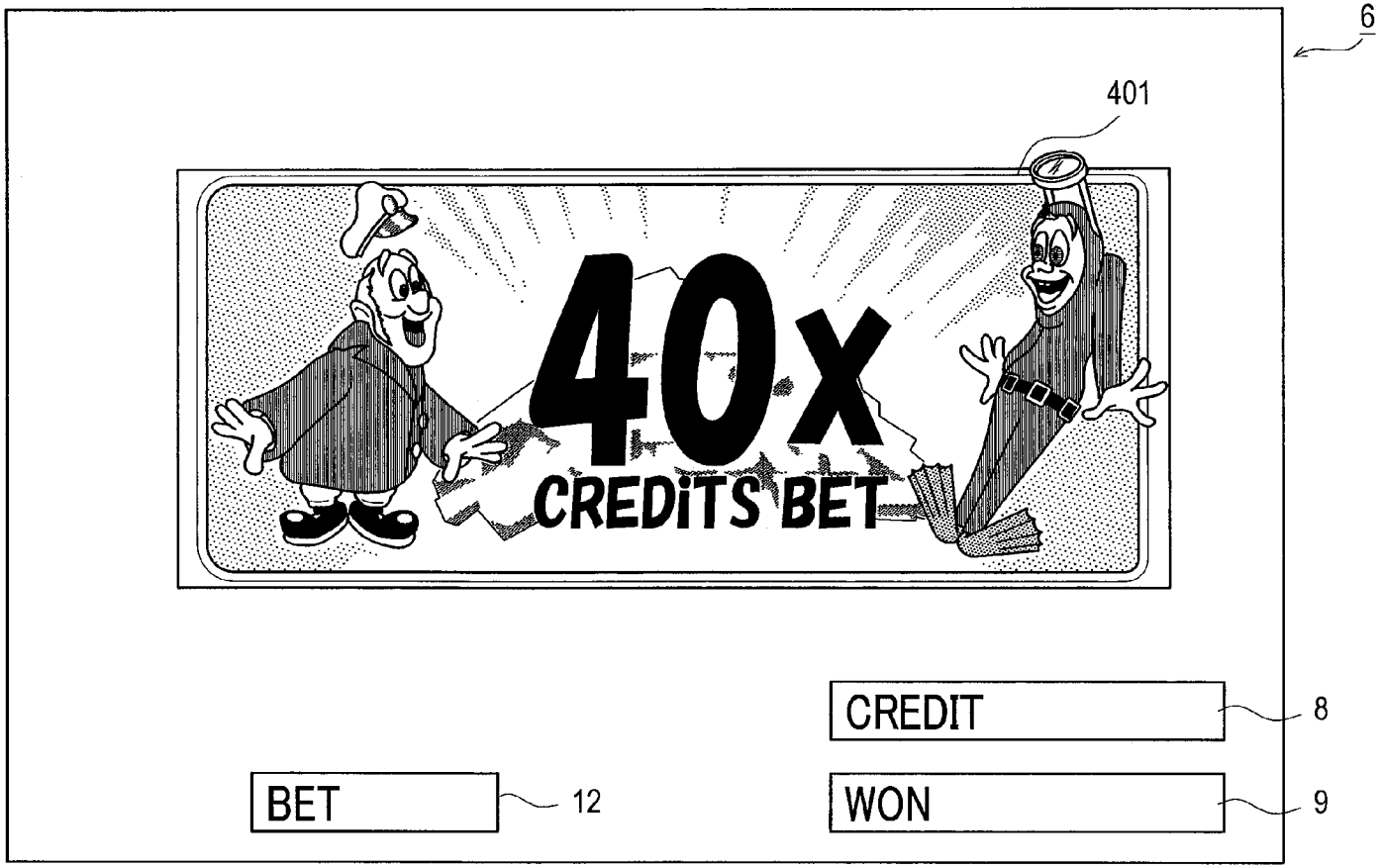
FIG. 23 is a view showing display content displayed on the lower image display panel in accordance with one or more aspects of the present invention.

FIG. 23 shows the display content of the result screen in the free game. When the free game is executed twenty times (at maximum) and finished, as shown in FIG. 23, the result screen is displayed with the character image 401 indicating that the outcome amount calculated by multiplying the bet number by forty will be obtained on the lower image display 6.

Therefore, the player can understand that the outcome amount calculated by multiplying the bet number in the unit game of the base game which precedes the free game by forty will be obtained. Here, in FIG. 23, the credit number display portion 8, the payout number display portion 9, and bet number display portion 12 are blank as a matter of description. However, appropriate numbers may be displayed in each of the portion in nature. Also, the bet number in the latest unit game of the base game which precedes the free game is displayed in the bet number display portion 12.

In the selection game, three treasure boxes, which are selection items, are displayed on the lower image display panel 6. The bet number, which is betted in the latest base game which precedes the selection game, is multiplied by the multiple number corresponding to the item of the selected treasure box by the player, will be provided to the player.

Figure 17:
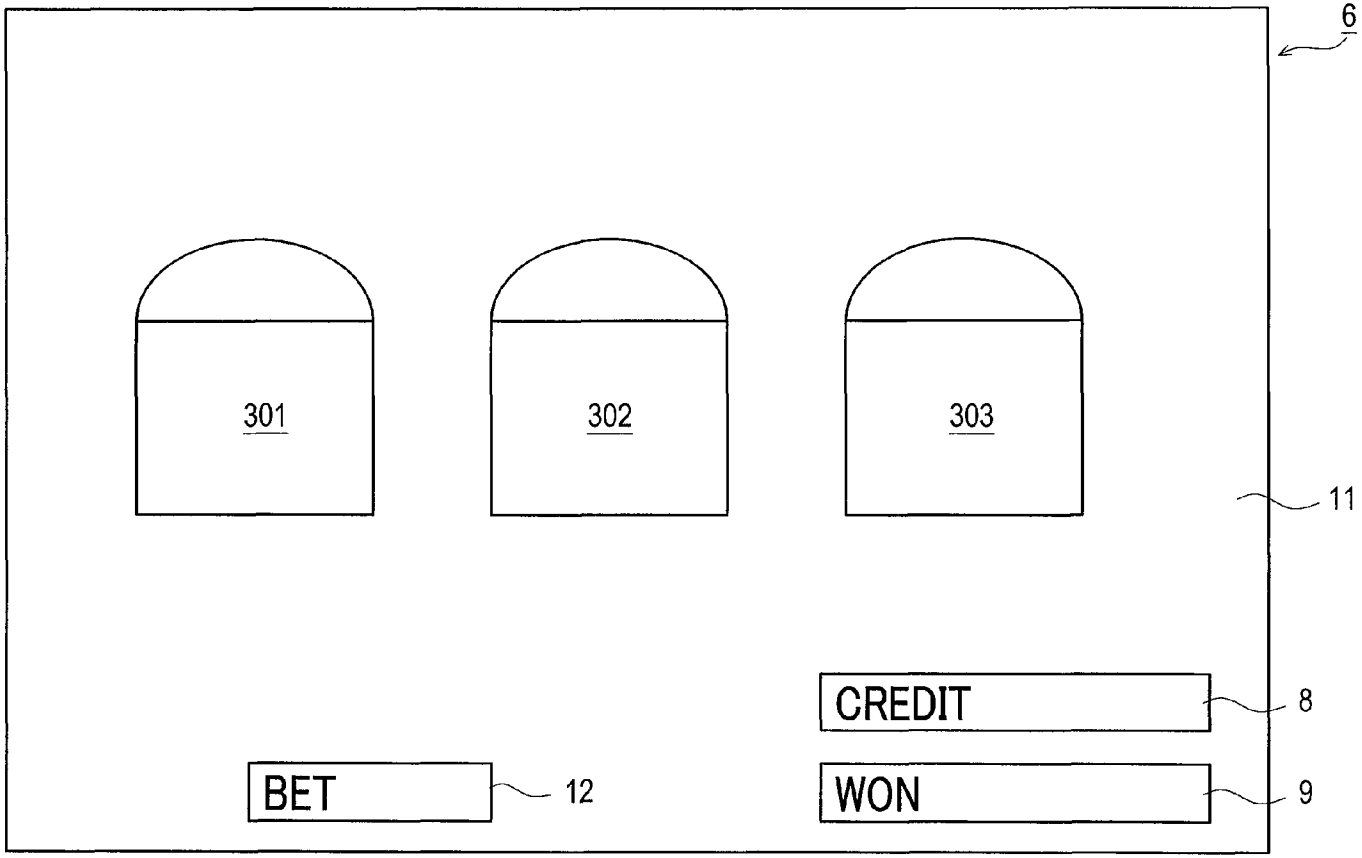
FIG. 17 is a view showing display content displayed on the lower image display panel in accordance with one or more aspects of the present invention.

FIG. 17 shows the display contents displayed in the selection game on the lower image display panel 6. FIG. 17 shows the selection screen of the selection game. If the procedure is shifted to the selection game, as shown in FIG. 17, three treasure boxes 301, 302, and 303 are displayed on the selection screen on the lower image display panel 6. Each of three treasure boxes 301, 302, and 303 corresponds to any of a diamond item, a gold item, or none of items. The player selects one of the treasure boxes among three treasure boxes 301, 302, or 303 by touching via the touch panel 11.

Here, if the player selects the treasure box corresponding to the diamond item, the bet number will be multiplied by "30" corresponding to the diamond item, and the multiplied number will be provided to the player.

If the player selects the treasure box corresponding to the gold item, the bet number will be multiplied by "5" corresponding to the gold item, and the multiplied number will be provided to the player.

If the player selects the treasure box corresponding to none of the items, the game is lost. If the game is lost, none of the payout number will be provided.

Figure 19:
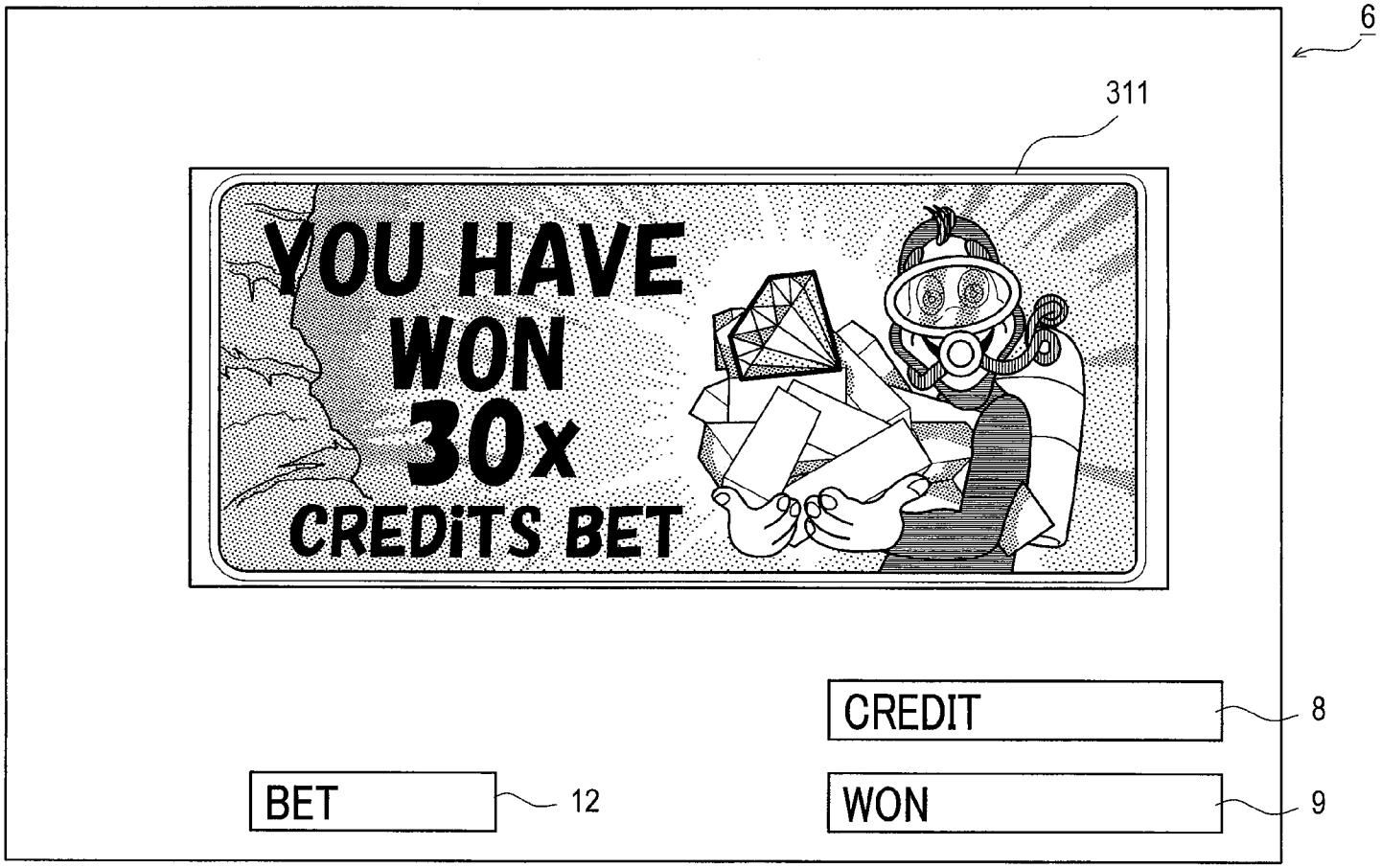
FIG. 19 is a view showing display content displayed on the lower image display panel in accordance with one or more aspects of the present invention.
Figure 20:
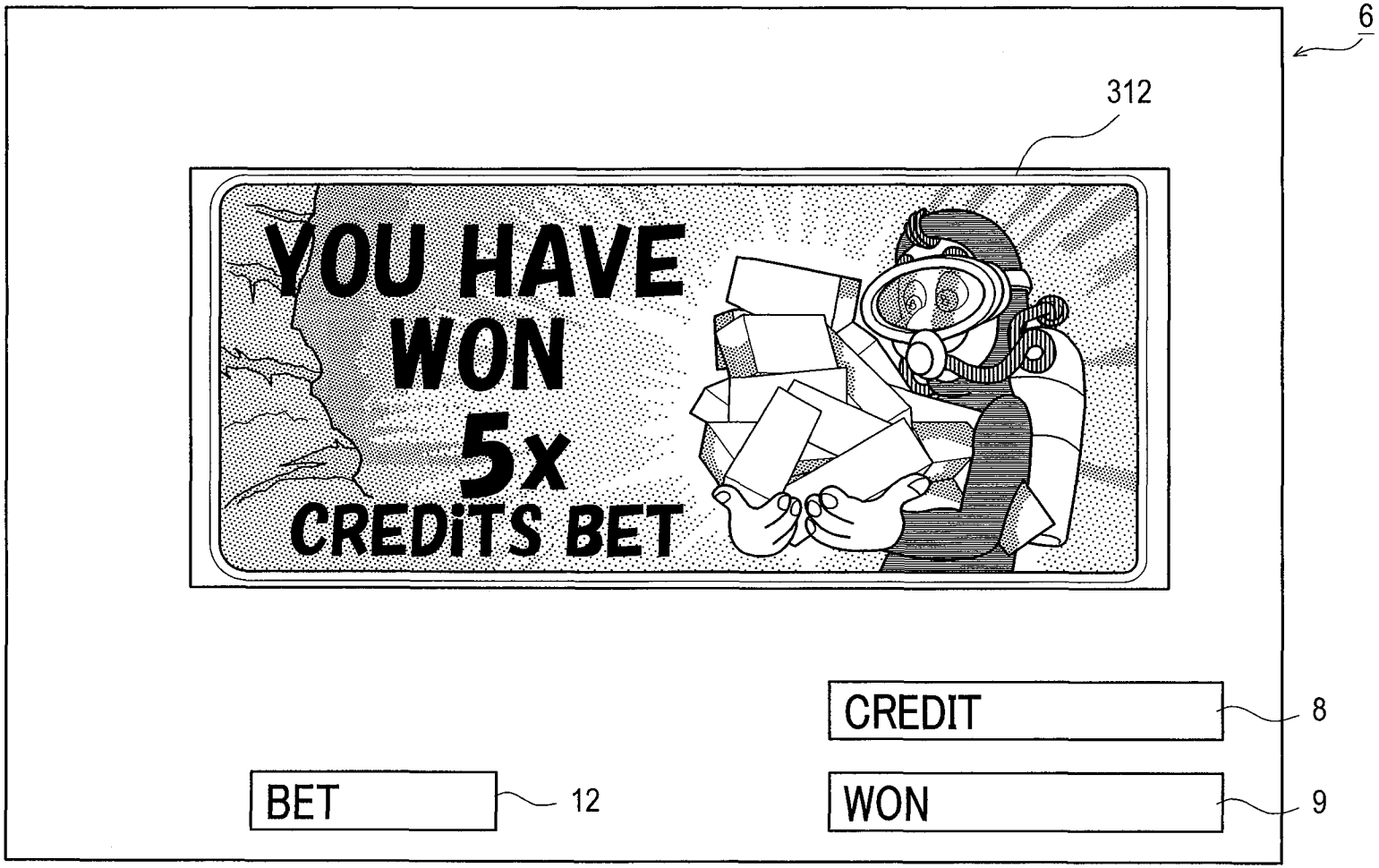
FIG. 20 is a view showing display content displayed on the lower image display panel in accordance with one or more aspects of the present invention.

FIGS. 19 and 20 show the display contents displayed on the lower image display panel 6. FIGS. 19 and 20 show the selection screen of the selection game.

If the player selects the treasure box in which the diamond is arranged, as shown in FIG. 19, the result screen with the character 311 indicating that the outcome amount calculated by multiplying the bet number by thirty will be obtained on the lower image display 6.

Therefore, the player can understand that the outcome amount calculated by multiplying the bet number in the unit game of the base game which precedes the selection game by thirty will be obtained.

If the player selects the treasure box in which the gold is arranged, as shown in FIG. 20, the result screen with the character 312 indicating that the outcome amount calculated by multiplying the bet number by five will be obtained on the lower image display 6.

Therefore, the player can understand that the amount calculated by multiplying the bet number in the unit game of the base game which precedes the selection game by five will be obtained.

Here, in FIGS. 19 and 20, the credit number display portion 8, the payout number display portion 9, and bet number display portion 12 are blank as a matter of description. However, appropriate numbers may be displayed in each of the portion in nature. Also, the bet number in the latest unit game of the base game which precedes the free game is displayed in the bet number display portion 12.

If the player eventually obtains the payout number in the bonus game (free game or selection game), the Double Down game, in which the payout number will be increased or decreased, can be executed. Here, an explanation thereof is omitted.

Figure 6:
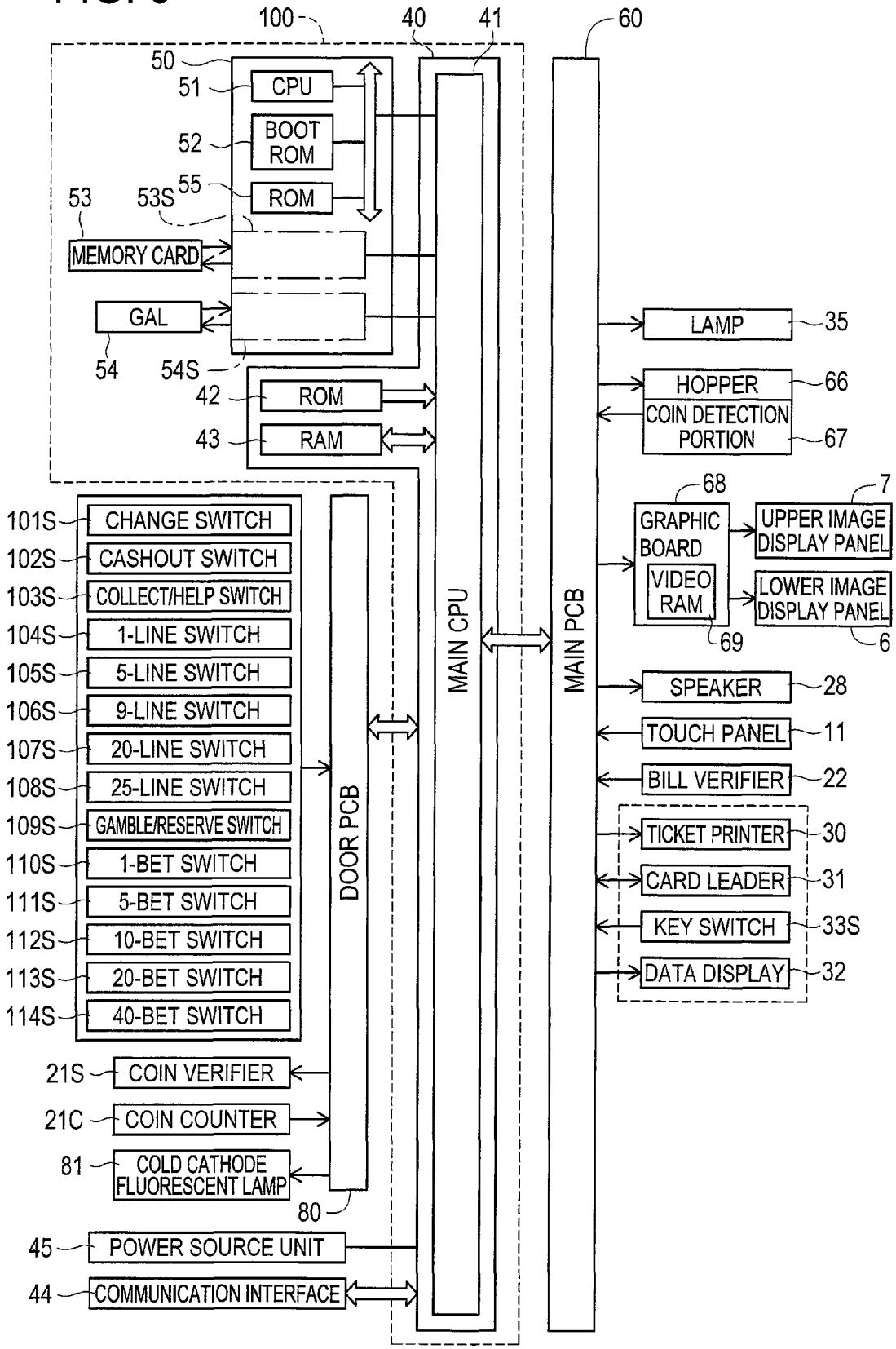
FIG. 6 is a block diagram schematically showing a control system of the slot machine in accordance with one or more aspects of the present invention.

A control system of the slot machine 1 of the embodiment will be described with reference to FIG. 6. FIG. 6 is a block diagram schematically showing the control system of the slot machine 1 of the embodiment.

The control system of the slot machine 1 may be constructed from a mother board 40 and a gaming board 50 as shown in FIG. 6.

The gaming board 50 may include a CPU 51, a ROM 55, a boot ROM 52, a card slot 53S, and an IC socket 54S. The CPU 51, the ROM 55, and the boot ROM 52 are interconnected via internal bus. A card slot 53S is adapted to receive the memory card 53. An IC socket 54S is adapted to receive a GAL (Generic Array Logic) 54. Here, PLD (Programmable Logic Device) which is other than the GAL 54 may be substituted for the GAL 54.

The memory card 53 may be constructed from non-volatile memory. Game programs and game system programs (hereinafter, "the game program and the like") may be stored therein. The game programs stored in the memory card may include lottery program. The lottery program may be used so as to determine symbols (namely, code numbers corresponding to symbols) of the video reels 5A, 5B, 5C, 5D, and 5E to be displayed on the payline L. The symbol lottery program may include three symbol weighting data table. Each of the weighting data tables corresponds to each plural payout ratios (for example, 80%, 84%, and 88%). The symbol weighting data table may indicate a relation between each of the code numbers for each symbol of the reels 5A, 5B, 5C, 5D, and 5E and one or more random number values belonging predetermined range (for example, "0" to "255"). Accordingly, if random number is sampled, the symbol corresponding to sampled random number value may be arranged. Also, if the random number value is sampled, the symbols corresponding to the sampled random number is repositioned and displayed on the lower image display panel 6.

Here, the payout ratio may be set based on the payout ratio setting data from the GAL 54. Various lotteries may be conducted based on the symbol weighting data corresponding to the payout ratio.

The card slot 53S may be constructed so that the memory card 53 is detachable, and connected to the mother board 40 via bus (for example, IDE bus). The kinds of the game and the contents of the game executed in the slot machine 1 can be changed in a case where the game program and the like stored in the memory card 53. Also, the kinds of games and the contents of the games executed in the slot machine 1 can be changed in a case where the memory card 53 is exchanged to another memory card in which another game program or the like is stored therein.

The game program may include the program related to the gaming session, the image data and sound data as output during the gaming session. Also, the game program may include image data of symbol images displayed on the outer surface of the each reel 5A, 5B, 5C, 5D, and 5E, the image data such as game rules and payout table, image data for demonstration, and the character image.

The GAL 54 can be one of the PLD, which may contains a fixed OR array. The GAL 54 has plural input ports and output ports. If predetermined data is input to the input port(s), the data corresponding thereto will output to the output port(s). The output data is the payout ratio setting data.

The IC socket 54S is constructed so that the GAL 54 is detachable, and connected to the mother board 40 via a bus (for example, PCI bus). The payout ratio setting data can be changed in a case where the GAL 54 is re-written or is exchanged.

The CPU 51, the ROM 55, and the ROM 52 are connected to the mother board 40 via the PCI bus. The CPU 51, the ROM 55, and the boot ROM 52 are interconnected via internal bus. The PCI bus transmits the signal between the mother board 40 and the gaming board 50. The mother board 40 supplies the electric power to the gaming board 50. The country ID and the verification program are stored in the ROM 55. The preliminary verification program and the boot code may be stored in the boot ROM 52. The CPU 51 may boot the preliminary verification program with the use of the boot code.

The verification read program is used to verify the game program and the like. The verification program is executed to check whether or not falsification of data has been done. The verification program checks for the falsification of the game program and the like. The game program and the like will be the object of the verification read process. A preliminary verification program may or may not be used to verify the verification program. The preliminary verification program is written along the procedure for the check of falsification of the verification program. The verification program can be the subject of the verification process.

The mother board 40 will be described. The mother board 40 may be constructed from general mother board (printed circuit board which mounts basic components), and may include a main CPU 41, a ROM 42, a RAM 43, and a communication interface 44.

The ROM 42 may be constructed from a memory device such as the flash memory (for example). The preliminary data such as BIOS program and the payout table in the base game and the bonus game (see FIG. 6) and a combination table (see FIG. 7) may be stored in the ROM 42. BIOS program can be executed by the main CPU 41. If the BIOS is executed by the main CPU 41, the initial process for predetermined peripheral devices, and the read process for the game program and the like stored in the memory card 53 will be started via the gaming board 50.

The data and the program, which are used when the main CPU 41 runs, are stored in the RAM 43. The verification program (which will be read via the gaming board 50), various programs (such as the game program and the like), the number of the player's credits, and the number of executed games may be stored in the RAM 43.

The communication interface 44 can be a communication device communicating to the server located in the game hall via a communication line or other communication pathway. The slot machine 1 may communicate bet information in the main game process (which will be described later, see S3 of FIG. 14) and/or the random result of a base winning combination lottery process with the server via the communication interface.

A main PCB (Printed Circuit Board) 60 and a door PCB 80 (which will be described later) are connected to the mother board 40 respectively via USB (for example). A power source unit 45 is connected to the mother board 40. If the power source unit 45 supplies the electric power to the mother board 40, the main CPU 41 on the mother board 40 will be booted up. When the electric power is supplied to the gaming board 50, the CPU 51 will be booted up.

A game controller 100 may be constructed from the mother board 40 and the gaming board 50.

Some devices, which generate the input signal to the game controller 100, are connected to the main PCB 60 and the door PCB 80. Some devices, which are control by the control signal from the game controller 100, are connected to the main PCB 60 and the door PCB 80. The game controller 100 executes the game program and the like stored in the RAM 43 based on the input signal which is input thereto. The game controller 100 stores the calculation result to the RAM 43 and controls some devices by executing predetermined calculation process.

The lamp 35, a sub CPU 61, a hopper 66, a coin detection portion 67, a graphic board 68, the loudspeaker 28 (see FIG. 2), a touch panel 11, the bill verifier 22, the ticket printer 30, the card reader 31, a key switch 33, and data display 32 may be connected directly or indirectly to the main PCB 60.

The touch panel 11 may be arranged in front of the lower image display panel 6. The touch panel 11 can recognize the place where the player touches the touch panel 11 based on the coordinate information of the portion touched by the player. Also, the touch panel 11 can recognize the direction where the player touches and moves based on the coordinate information of the portion touched by the player.

The hopper 66 may be arranged inside of the cabinet 2. The hopper 66 pays a payout with coins through the coin payout opening 23 to the coin tray 24 based on the control signal from the game controller 100. The coin detection portion 67 is arranged inside of the coin payout opening 23. If the coin detection detects that predetermined coins are paid through the coin payout opening 23, the coin detection portion will output the signal to the game controller 100.

The graphic board 68 controls the display image on the upper image display panel 27 and the lower image display panel 6 based on the control signal from the game controller 100. The player's credit count, stored in the RAM 43, may be displayed of the credit count display portion 8. The payout number of credits may be displayed on the payout number display portions 9. The player's bet value may be displayed in the bet value display portion 12.

The graphic board 68 may include VDP (Video Display Processor) and a video RAM. The image data generated by the VDP is temporarily stored in the video RAM. The VDP generates the image data based on the control signal from the game controller 100. The data used when the image data is generated by the VDP may be included in the game program.

The graphic board 68 controls so that video reels 5A, 5B, 5C, 5D, and 5E are spun and stopped on the lower image display panel 6 (see FIGS. 9 to 12) based on the control signal from the game controller 100.

Also, the graphic board 68 display-controls the bonus game on the lower image panel 6 based on the control signal from the game controller 100 (see FIGS. 17, 19, 20 and 23).

The bill verifier 22 verifies the bill or the ticket 25. The bill verifier 22 receives the qualified bill or the ticket 25 into the cabinet 2. When qualified bill is inserted, the bill verifier 22 will output the signal to the game controller 100 based on the value thereof. When qualified ticket 25 is inserted, the bill verifier 22 will output to the game controller 100 based on the number of coins printed thereon.

The ticket printer 30 prints the ticket with the bar code in which the data such as credit count stored in the RAM 43 based on the control signal from the game controller 100. The printed ticket is the ticket 25.

The card reader 31 reads from the storage medium (for example, smart card) and transmits the data, which is received by the game controller 100. The card reader writes the storage medium (for example, smart card) based on the control signal from the game controller 100. A keypad 33 is arranged on the key switch 33S. If the keypad 33 is operated by the player, the predetermined input signal will be output to the game controller 100. The data read by the card reader 31 or the data input by the player via the keypad 33 may be displayed on the data display 32 based on the control signal from the game controller 100.

The control panel 20, the coin verifier 21S, and the coin counter 21C are directly or indirectly connected to the door PCB 80. Here, a cold cathode fluorescent lamp 81 may be connected to the door PCB 80.

A CHANGE switch 101S, a CHASHOUT switch 102S, a COLLECT/HELP switch 103S, a 1-LINE switch 104S, a 5-LINE switch 105S, a 9-LINE switch 106S, a 20-LINE switch 107S, a 25-LINE switch 108, a GAMBLE/RESERVE switch 109S, a 1-BET switch 110S, a 5-BET switch 111S, a 10-BET switch 112S, a 20-BET switch 113S, a 40-BET switch 114S are arranged on the control panel 20.

The CHANGE switch 101S is associated with the CHANGE button 101 (see FIG. 3). The CHSHOUT switch 102S is associated with the CASHOUT button 102 (see FIG. 3). The COLLECT/HELP switch 103S is associated with the COLLECT/HELP button 103 (see FIG. 3). The 1-LINE switch 104S is associated with the PLAY 1 LINE button 104 (see FIG. 3). The 5-LINE switch 105S is associated with the PLAY 5 LINE button 105 (see FIG. 3). The 9-LINE switch 106S is associated with the PLAY 9 LINE button 106 (see FIG. 3). The 20-LINE switch 107S is associated with the PLAY 20 LINE button 107 (see FIG. 3). The 25-LINE switch 108S is associated with the PLAY 25 LINE button 108 (see FIG. 3). The GAMBLE/RESERVE switch 109S is associated with the GAMBLE/RESERVE button 109 (see FIG. 3). The 1-BET switch 110S is associated with the RED BET 1 PER LINE button 110 (see FIG. 3). The 5-BET switch 111S is associated with the BET 5 PER LINE button 111 (see FIG. 3). The 9-BET switch 112S is associated with the BET 9 PER LINE button 112 (see FIG. 3). The 20-BET switch 113S is associated with the BET 20 PER LINE button 113 (see FIG. 3). The 40-BET switch 114S is associated with the BET 40 PER LINE button 114 (see FIG. 3). Each of switches may output the input signal to the game controller 100 when the button corresponding thereof is operated by the player.

The coin counter 21C is arranged inside of the coin slot 21. The coin counter 21C verifies the coin inserted from the coin slot 21 by the player. Any fake coins may be discharged through the coin payout opening 23. If a qualified coin is detected, the coin counter 21C will output the signal to the game controller 100.

The coin verifier 21S is controlled based on the control signal from the game controller 100. The coin verifier 21S sorts the qualified coins into a cash box (not shown) or the hopper 66. The cash box is arranged inside of the slot machine 1. Here, the lower image display panel 6 is a LED. A cold cathode fluorescent lamp 81 may be arranged back side of the lower image display panel 6 and the upper image display panel 27. Here, a cold cathode fluorescent lamp 81 functions as a back light and turns on based on the control signal from the game controller 100.

The winning combination and payout number thereof, in the base game and the free game using the activated reels 5A, 5B, 5C, 5D, and 5E in the slot machine 1 of the embodiment, will be described with reference to FIG. 7. FIG. 7 shows a payout table which indicates the winning combination and the payout number thereof, in the base game and the free game using the reels 5A, 5B, 5C, 5D, and 5E.

FIG. 7 indicates the payout number in the case where the bet number is "1". If the bet number is "1", the payout number shown in FIG. 7 will be provided to the player.

If the bet number is more than "1", the payout number shown in FIG. 7 will be multiplied by the bet number, and multiplied number will be provided to the player. Here, the payout table shown in FIG. 7 is displayed on the upper image display panel 7. Also, the payout table is stored in the ROM 42.

The "Gold Box" symbol 212 may make up one kinds of the winning combination. If three "Gold Box" symbols 212 are displayed regardless of whether being displayed on the activated payline on the lower image display panel 6, the payout number "10" will be provided.

Also, in this case, the free game trigger is realized in the base game, so the free game occurs. On the other hand, if two "Gold Box" symbols 212 are displayed regardless of whether being displayed on the activated payline on the lower image display panel 6, the selection game occurs.

The "Captain" symbol 201 may make up four kinds of the winning combination. If five "Captain" symbols 201 are repositioned on the activated payline L on the lower image panel 6, "400" credits will be provided per bet number. If four "Captain" symbols 201 are repositioned on the activated payline L, "150" credits will be provided per bet number. If three "Captain" symbols 201 are repositioned on the activated payline L, "20" credits will be provided per bet number. If two "Captain" symbols 201 are repositioned on the activated payline L, "3" credits will be provided per bet number.

The "Scuba" symbol 202, the "Lifevest" symbol 203, the "Radar" symbol 204, the "Periscope" symbol 205, the "Submarine" symbol 206, the "Ace" symbol 208, "King" symbol 209, "Queen" symbol 210, and the "Jack" symbol 211 have winning combination (s) corresponding to payout number, in the same manner as above.

The "Claim" symbol 207 may make up four kinds of the winning combinations. If five "Clam" symbols 207 are displayed on the lower image display panel 6 regardless of whether being repositioned on the activated payline L, the payout number "50" will be provided per bet number. If four "Clam" symbols 207 are displayed, the payout number "15" will be provided per bet number. If three "Clam" symbols 207 are displayed, the payout number "5" will be provided per bet number. If two "Clam" symbols 207 are displayed, the payout number "1" will be provided per bet number.

The "Sawfish" symbol 213 may make up one kinds of the winning combination. If one "Sawfish" symbol 213 is displayed on the lower image display panel 6 regardless of whether being repositioned on the payline, the payout number "1" will be provided per bet number.

Here, the combination of symbols is not any of the winning combinations shown in FIG. 7, the game is lost. If the game is lost, none of the payout number will be paid.

Additional payout numbers in the base game with the activated paylines in the slot machine of the embodiment will be described with FIG. 8. FIG. 8 shows a payout table indicating a relation between the number of the activated paylines L and payout number corresponding thereto when the base game is executed.

According to the payout table of FIG. 8, if any of the winning combinations is displayed on the activated payline L and all of twenty five paylines are activated on the lower image display panel 6, the credit number "500" will be additionally provided as additional payout number in addition to the payout number corresponding to the winning combination (see FIG. 7). Also, in a similar way, if twenty paylines L1 to L20, nine paylines L1 to L9, or five paylines L1 to L5 are activated, additional payout number is defined based on the number of the activated paylines, as shown in FIG. 8.

An allocation of items in the treasure boxes when the selection game is executed in the slot machine 1 of the embodiment will be described. FIG. 18 shows a lottery table showing the allocation of the items in the treasure boxes in the base game.

In the selection game, the player selects one treasure box among three treasure boxes 301, 302, or 303 on the selection screen of the lower image display panel 6 (see FIG. 17). According to the lottery table shown in FIG. 18, the diamond item will be stored in zero or one treasure box among three treasure boxes 301, 302, and 303. The gold items will be stored in one or two treasure boxes among three treasure boxes 301, 302, and 303. That is, the diamond item corresponds to plural random number values. The random number is sampled by lottery. The diamond item will be arranged in the treasure box corresponding to the sampled random number value. In the same manner, the gold item corresponds to plural random number values. The random number is sampled by lottery. The gold item will be arranged in the treasure box corresponding to the sampled random number value. Here, the number of the treasure boxes in which the diamond item or the gold item arranged does not reach three, the treasure box not corresponding to any of the sampled random number is empty.

It is determined which treasure box (among three treasure boxes 301, 302, or 303) has the diamond item, which treasure box has the gold item, which treasure box has no item based on the lottery result. The lottery result is conducted based on the random number value (see S16 of FIG. 41 which will be described later). The lottery results are stored in the RAM 43 as the selection information.

Figure 13:
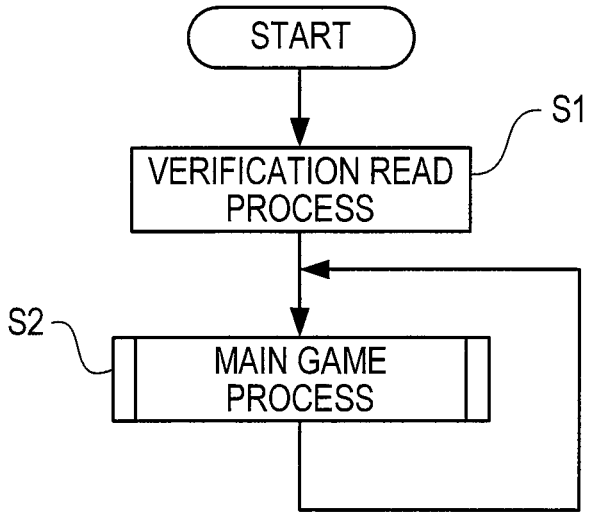
FIG. 13 is a flowchart of a main control program in accordance with one or more aspects of the present invention.

A main control program, which is executed in the slot machine 1 of the embodiment, will be described in detail with reference to the drawing. FIG. 13 is a flowchart of the main control program.

Concerning the slot machine 1, the memory card 53 is connected to the card slot 53S of the gaming board 50, and the GAL 54 is connected to the IC socket 54S.

When the power switch of the power source unit 45 is ON, the game controller 100 are booted-up, and the verification read process (S1) is executed. Here, the game controller 100 may be constructed form the mother board 40 and the gaming board 50. In the verification read process, the mother board 40 and the gaming board 50 execute separate processes in parallel.

In the gaming board 50, the CPU 51 reads the preliminary verification program from the boot ROM 52, and verifies that the verification program is not falsified before the verification program is taken to the mother board 40.

In the mother board 40, the main CPU 41 executes BIOS stored in the ROM 42, and checks and initializes various peripheral devices. Here, BIOS may be compressed, then, BIOS is decompressed. BIOS may be copied to the RAM 43.

The game controller 100 reads the verification program stored in the ROM 55, and verifies that game program and the like are not falsified. Here, the game program and the like is stored in the memory card 53 which is inserted to the card slot 53S. After the verification process is ended, the game controller 100 writes program to the RAM 43, and acquires payout data and country ID.

After the process mentioned above is finished, the game controller 100 finishes the verification read process.

In S2, the game controller 100 reads the game program and the like which was verified in S1 from the RAM 43, and executes the main game process. The game in the slot machine 1 of the embodiment is executed by executing the main game process. The main game process is executed repeatedly during the electronic power source is supplied.

Figure 14:
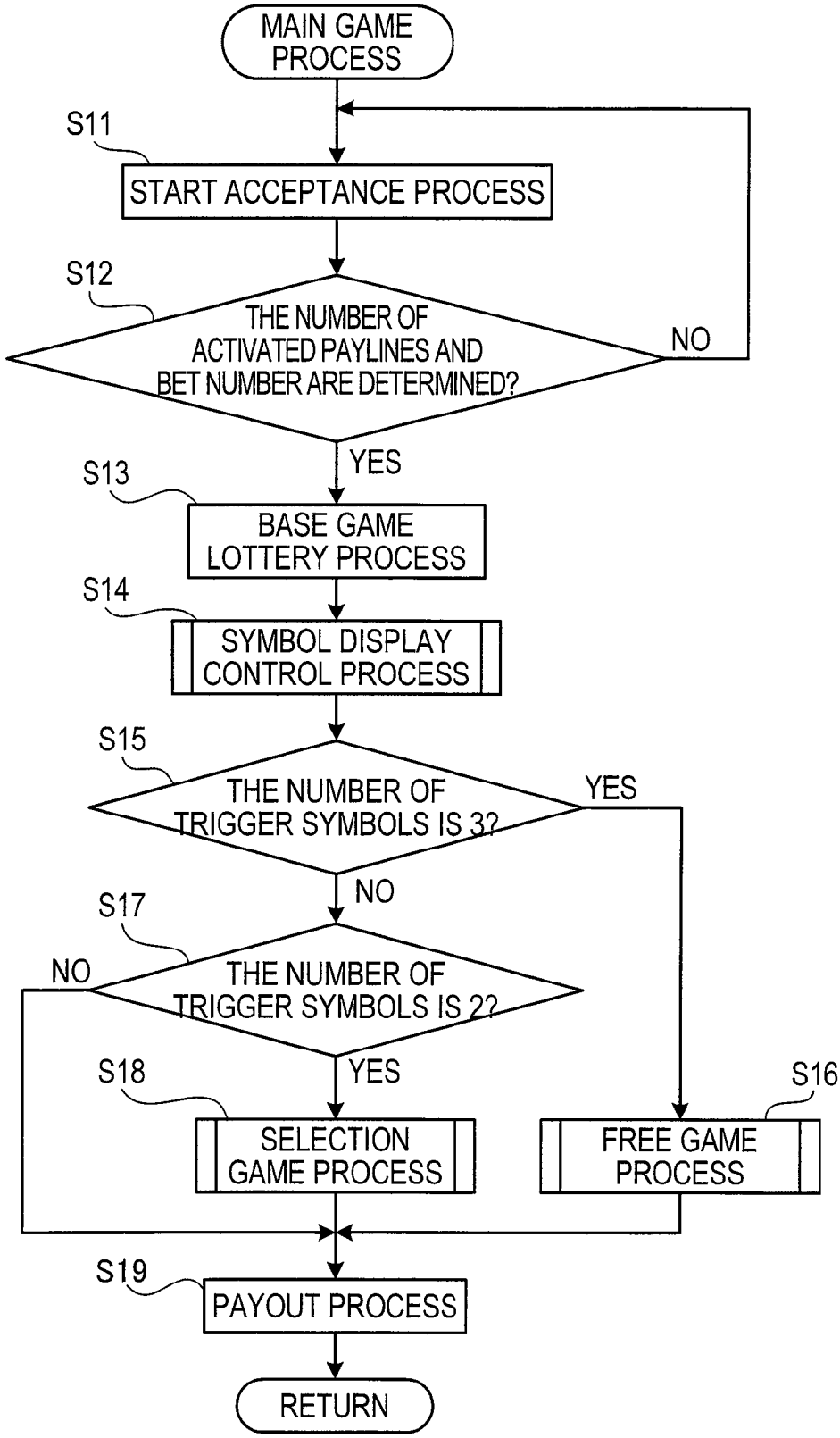
FIG. 14 is a flowchart of a main game program in accordance with one or more aspects of the present invention.

A sub process of the main game process in S2 will be described with reference to FIG. 14. FIG. 14 is a flowchart of the main game process in the slot machine 1 of the embodiment. Here, each of the programs shown in the flowcharts in FIG. 14 is stored in the ROM 42 or the RAM 43, and executed by the game controller 100.

In S11, the game controller 100 performs predetermined initial setting, and then, executes the start acceptance process as shown in FIG. 14. The bet number and the number of the activated paylines are set in the start acceptance process.

In the start acceptance process, the game controller 100 allows the operations of the PLAY 1 LINE button 104, the PLAY 5 LINE button 105, the PLAY 9 LINE button 106, the PLAY 20 LINE button 107, and the PLAY 25 LINE button 108. After that, when the player operates any of the buttons, the game controller 100 sets the number of the activated paylines L based on the player's operation. Based on this determination, it is determined which paylines are activated among the twenty five paylines L. For example, if the player operates the PLAY 5 LINE button 105, the game controller 100 activates five paylines L1 to L5 based on the input signal from the 5-LINE switch 105S.

After above determination, the game controller 100 allows the RED BET 1 PER LINE button 110, the BET 5 PER LINE button 111, the BET 10 PER LINE button 112, the BET 20 PER LINE button 113, and the BLACK BET 40 PER LINE button 114 to be pressed. If the player operates any of the buttons, the game controller 100 sets the bet number per activated payline L. For example, if the player operates the BET 20 PER LINE button 113, the game controller 100 sets the bet number per activated payline L "20" based on the 20-BET switch 113S.

Here, if the player operated any of the RED BET 1 PER LINE button 110, the BET 5 PER LINE button 111, the BET 10 PER LINE button 112, the BET 20 PER LINE button, or the BLACK BET 40 PER LINE button 114, all of reels 5A, 5B, 5C, 5D, and 5E are started to spin on the lower image panel 6.

In the start acceptance process, the credit number in which the player currently owns may be increased by putting in the coins or the like.

In S12, the game controller 100 determines whether or not the number of the activated paylines L and the bet number are set.

Here, if the player operates any of the RED BET 1 PER LINE button 110, the BET 5 PER LINE button 111, the BET 10 PER LINE button 112, the BET 20 PER LINE button 113, or the BLACK BET 40 PER LINE button 114, it is determined that the number of activated paylines L and the bet number are set.

The game controller 100 determined based on whether the input signal is received from any of the 1-BET switch 110S, the 5-BET switch 111S, the 10-BET switch 112S, the 20-BET switch 113S, or the 40-BET switch 114S. If it is determined that the number of the activated paylines L or the bet number is not set (S12:NO), the procedure will be returned to the start acceptance process (S11) again.

On the other hand, if it is determined that the number of the activated paylines L and the bet number are set (S12:YES), the procedure will be shifted to S13. Here, the game controller 100 stores the number of activated paylines (as the activation information) in the RAM 43, and sends the display control signal to the graphic board 68. Therefore, the paylines L corresponding to activation of the paylines L are visible on the lower image display panel 6. Accordingly, the player can understand which paylines are activated among the twenty five paylines L1 to L25.

The game controller 100 stores the bet number (as the bet information) in the RAM 43, and outputs the display control signal to the graphic board 68. Therefore, the bet number is displayed on the bet number display portion 12 on the lower image display panel 6. Also, the game controller 100 calculates the amount by multiplying the number of the activated paylines L by the bet number. And then, the calculated amount is subtracted from the number of credit information (the credit number in which the player currently owns).

The game controller 100 overwrites the subtracted number (as the credit information) in the RAM 43, and outputs the display control signal to the graphic board 68. Therefore, the credit information is displayed on the credit number display portion 8 of the lower image display panel 6.

As described above, the player can change the number of the activated paylines L by operating the PLAY 1 LINE button 104, the PLAY 5 LINE button 105, the PLAY 9 LINE button 106, the PLAY 20 LINE button 107, and the PLAY 25 LINE button 108 again before the RED BET 1 PER LINE button 110, the BET 5 PER LINE button 111, the BET 10 PER LINE button 112, the BET 20 PER LINE button 113, and the BLACK BET 40 PER LINE button 114 is operated, even though the number of the activated paylines is already set on the basis of the operation of the PLAY 1 LINE button 104, the PLAY 5 LINE button 105, the PLAY 9 LINE button 106, the PLAY 20 LINE button 107, and the PLAY 25 LINE button 108 by the player.

Also, if the player wants to start spinning all of the reels 5A, 5B, 5C, 5D, and 5E in the currently unit game without changing the number of the activated paylines in the previous unit game, the player can operate the RED BET 1 PER LINE button 110, the BET 5 PER LINE button 111, the BET 10 PER LINE button 112, the BET 20 PER LINE button 113, or the BLACK BET 40 PER LINE button 114 without operating the PLAY 1 LINE button 104, the PLAY 5 LINE button 105, the PLAY 9 LINE button 106, the PLAY 20 LINE button 107, or the PLAY 25 LINE button 108.

In S13 and after, the game controller 100 executes the base game process with the use of the reels 5A, 5B, 5C, 5D, and 5E.

Beginning in S13, the game controller 100 executes the base game lottery process.

Concretely, the game controller 100 executes random number value generation program included in lottery program stored in the RAM 43, at result, each of five random number values of each reel 5A, 5B, 5C, 5D, and 5E is generated from the predetermined range of the random number value ("0" to "255", for example). The code numbers of each the reels 5A, 5B, 5C, 5D, and 5E may be determined based on three random number values and the symbol weighting table. Each of the symbol weighting tables corresponds to the payout ratio setting data. The procedure will be shifted to S14 after the code numbers of each of the reels 5A, 5B, 5C, 5D, and 5E are stored in the RAM 43.

Here, each of the code number of each of reels 5A, 5B, 5C, 5D, and 5E corresponds to each of the code numbers of symbols to be repositioned on the payline L1. Accordingly, if the game controller 100 determines the symbols to be repositioned on the payline L1, the symbols to be repositioned on the paylines L2 and L3. Therefore, the combination of the symbols in the unit game is determined.

In S14, the game controller 100 executes the symbol display control process.

In this process, all reels 5A, 5B, 5C, 5D, and 5E are started to spin, and then each of the reels 5A, 5B, 5C, 5D, and 5E are stopped so that the symbols determined in the base game lottery process (S13) are repositioned on the payline L.

Figure 15:
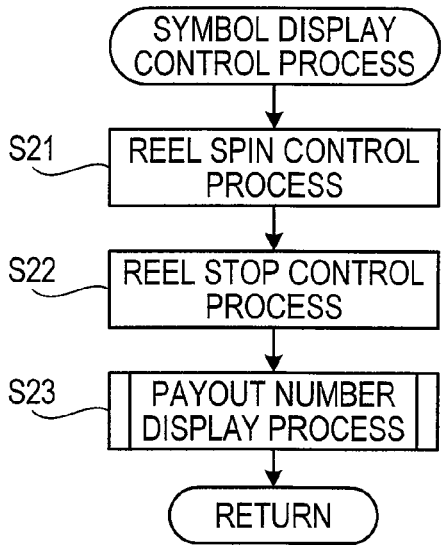
FIG. 15 is a flowchart of a main control process program in accordance with one or more aspects of the present invention.

A sub process of the symbol display control process of S14 will be described with reference to FIG. 15. FIG. 15 is a flowchart of the sub process of the symbol display control process in the slot machine 1 of the embodiment. Here, each of the programs shown in the flowchart in FIG. 15 is stored ROM 42 or RAM 43, and is executed by the game controller 100. Also, this process may be executed by the game controller 100 and the graphic board 68.

In the symbol display control process of S14, as shown in FIG. 15, in S21, the game controller 100 executes the reel spin control process. Here, the game controller 100 sends the start signal that instructs the video reels start to spin to the graphic board 68. When the graphic board 68 receives the start signal, the graphic board 68 will executes the video reel spin display process. That is, the graphic board 68 controls so that each of the video reels 5L, 5C, and 5R are spun and displayed on the lower image display panel 6. After the start signal is sent, production patterns (for example, the image display on the upper image display panel 7 and output sound from the loudspeaker 28) are determined, and the determined production pattern will be conducted.

In S22, the game controller 100 executes the reel stop control process. When it becomes predetermined timing in which the reels 5A, 5B, 5C, 5D, and 5E are to be stopped, the game controller 100 will transmit the code numbers of reels stored in the RAM 43 to the graphic board 68. The graphic board 68 executes the reel stop display process based on the code numbers of reels. Accordingly, the symbols corresponding to the lottery result of S13 will be repositioned and displayed on the payline L on the lower image display panel 6.

In S23, the game controller 100 executes the payout number display process.

A sub process of the payout number display process of S23 will be described with reference to FIG. 1. FIG. 1 is a flowchart of the sub process of the payout number display process in the slot machine 1 of the embodiment. Here, each of the programs shown in the flowchart in FIG. 1 is stored ROM 42 or RAM 43, and is executed by the game controller 100. Also, this process may be executed by the game controller 100 and the graphic board 68.

In the payout display process of S23, as shown in FIG. 1, in S31, the game controller 100 calculates the payout number. The game controller 100 determines whether or not the winning combination is realized based on the repositioned symbols on the activated paylines L. Also, the game controller 100 determines whether or not the winning combination is realized using the scatter symbols regardless of whether being displayed on the activated payline L.

If it is determined that the winning combination is realized, the game controller 100 calculates the outcome amount by multiplying the payout number corresponding to the winning combination by the bet number. Here, if plural winning combinations are realized, the outcome amount calculated by multiplying sum of each payout number by the bet number will be provided.

Also, this determination and calculation are based on the payout table shown in FIG. 7, and the calculated outcome amount is stored in the RAM 43.

In S32, the game controller 100 adds the payout numbers. If it is determined in S31 that the winning combination of the repositioned symbols on the activated payline L is realized, the payout number corresponding to the activated paylines L will be added to the payout number calculated in S31. Here, this process is executed based on the payout table shown in FIG. 8. And, added payout number is stored in the RAM 43, as the payout information.

In S33, the game controller 100 displays the payout number. Here, the game controller 100 sends the display control signal to the graphic board 68. Herewith, the payout information (the added number calculated in S32) is displayed in the payout number display portion 9 of the lower image display panel 6.

The game controller 100 returns the procedure to the main game process shown in FIG. 14 via the symbol display control process shown in FIG. 15.

In S15, the game controller 100 determines whether or not the number of the trigger symbols is three. Here, a meaning of "the number of the trigger symbols is three" is "three trigger symbols of the "Gold Box" symbols 212 are displayed on the lower image display panel 6 regardless of whether being repositioned on the activated payline". This determination is based on the lottery result of S13.

If it is determined that the number of the trigger symbols is three (S15:YES), the procedure will be shifted to S16 and the free game (which will be described later) will be executed, and then, the procedure will be shifted to S19. On the other hand, if it is determined that the number of the trigger symbols is not three (S15:NO), the procedure will be shifted to S17.

In S17, the game controller 100 determines whether or not the number of the trigger symbols is two. Here, a meaning of "the number of the trigger symbols is two" is "two trigger symbols of the "Gold Box" symbols 212 are displayed on the lower image display panel 6 regardless of whether being repositioned on the activated payline". This determination is based on the lottery result of S13.

If it is determined that the number of the trigger symbols is two (S17:YES), the procedure will be shifted to S18 and the selection game (which will be described later) will be executed, and then, the procedure will be shifted to S19. On the other hand, if it is determined that the number of the trigger symbols is not three (S15:NO), the procedure will be shifted to S19 without executing the selection game process (which will be described later).

In S19, the game controller 100 executes the payout process. In the payout process, the game controller 100 provides the payout numbers, which are obtained in the base game and the bonus game by the player, to the player based on the payout information stored in the RAM 43.

When the payout is conducted, the game controller 100 adds the credit number corresponding to the payout information stored in the RAM 43 (namely, the payout number obtained in the base game and the bonus game by the player) to the credit number corresponding to the credit information stored in the RAM 43. And then, the added number is overwritten in the RAM 43 as the credit information.

And then, the game controller 100 sends the display control signal to the graphic board 68, and the credit information stored in the RAM 43 (the added number calculated in S19) will be displayed in the credit number display portion 8 of the lower image display panel 6. At the same time, the game controller 100 overwrites "0" in the RAM 43 as the payout information, and sends the display control signal the graphic board 68, "0" is displayed in the payout number display portion 9 of the lower image display panel 6.

In the payout process, if the player presses the CASHOUT button 102, coins with predetermined amount corresponding to the credit number (for example, one credit is equal to one coin) will be provided. Also, the ticket 25 with the barcode may be provided.

After that, the procedure will be shifted to the main game process.

Figure 21:
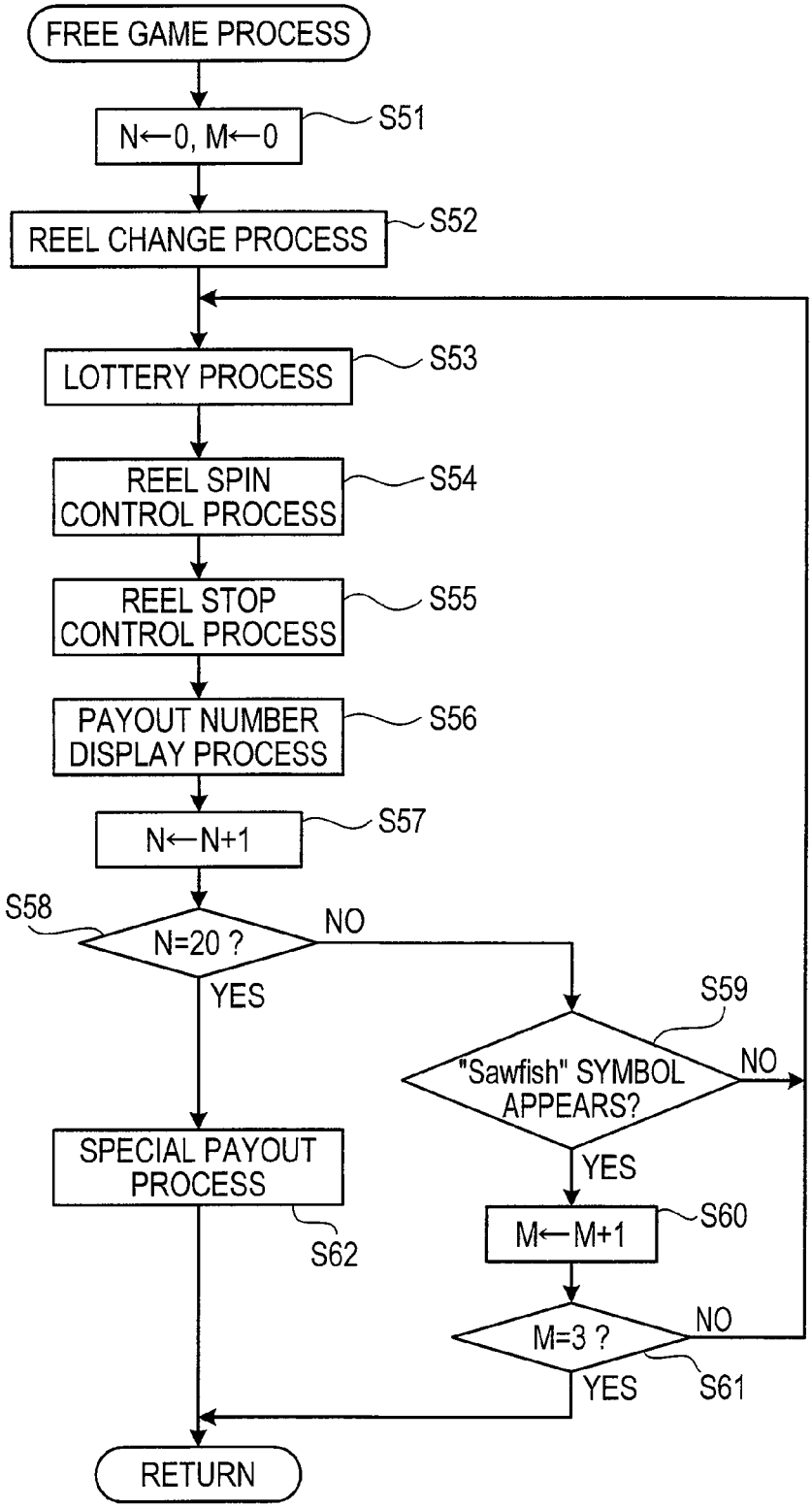
FIG. 21 is a flowchart of a free game process program in accordance with one or more aspects of the present invention.

A sub process of the free game process in S16 will be described with reference to FIG. 21. FIG. 21 is a flowchart of the sub process program of the free game process in the slot machine 1 of the embodiment. Here, each of the programs shown in the flowcharts of FIG. 21 is stored in the ROM 42 or the RAM 43, and executed by the game controller 100.

In the free game process of S16, as shown in FIG. 21, in S51, the game controller 100 puts "0" into variable number "N" and "M" stored in the RAM 43.

In S52, the game controller 100 executes reel change process. That is, the game controller 100 uses symbol columns shown in FIG. 22 in place of the symbol column shown in FIG. 4, as symbol columns displayed on each of the reels 5A, 5B, 5C, 5D, and 5E. Here, the control signal, in which indicates that the reels will be changed, is output from the game controller 100 to the graphic board 68.

The game controller 100 executes the lottery process of S53, the reel spin process of S54, the reel stop control process of S55, and the payout number display process of S56 in sequence. These steps are the same as the base game lottery process of S13 in the base game, the reel spin control process of S21, the reel stop control process of S22, and the payout number display process of S23 respectively.

However, the symbol columns used in the reels 5A, 5B, 5C, 5D, and 5E are symbol columns shown in FIG. 22.

In S57, the game controller 100 increments the variable number N by one.

In S58, the game controller 100 determines whether or not the variable number N is "20". If it is determined that the variable number N is not "20" (S59:NO), the number of executed free games is not "20" and the procedure will be shifted to S59. In S59, the game controller 100 determines whether or not the "Sawfish" symbol 213 appears. Here, a meaning of "the "Sawfish" symbol 213 appears" is "one "Sawfish" symbol 213 is repositioned and displayed in the window display 10C via the reel 5C on the lower image display 6 regardless of whether being repositioned each of the paylines L1 to L25". This determination is performed based on the lottery result of S53.

If it is determined that the "Sawfish" symbol 213 does not appear (S59:NO), the procedure will be returned to S53 and above process will be executed again. On the other hand, if it is determines that the "Sawfish" symbol 213 appears (S59: YES), the procedure will be shifted to S60. In S60, the game controller 100 increments the variable number M by one. And then, in S61, the game controller 100 determines whether or not the variable number M is "3". If it is determines that the variable number M is not "3" (S61:NO), the procedure will be returned to S53 and above process will be executed again. On the other hand, if it is determined that the variable number M is "3" (S61:YES), the number of free games, in which the "Sawfish" symbol 213 appears, reaches "3" and the free game will be executed, and the procedure will be returned to the main game process of FIG. 14.

On the other hand, in S58, if it is determined that the variable number N is "20" (S58:YES), the number of executed free games reaches twenty and the procedure will be shifted to S62. In S62, the game controller 100 executes the special payout process. In the special payout process, the game controller 100 calculates the outcome amount by multiplying the bet information (bet number) by forty. And then, the calculated outcome amount is added to the credit number (the payout number obtained in the base game by the player) corresponding to the payout information stored in the RAM 43. The game controller 100 writes the added number over the payout information stored in the RAM 43. Also, the game controller 100 outputs the display control signal to the graphic board 68. Therefore, the result screen is displayed with the character image 401 (see FIG. 23), and the payout information (the added number calculated in S62) is displayed in the payout number display portion 9 on the lower image display panel 6. After that, the free game is finished and the procedure will be returned to the main game process of FIG. 14.

Figure 16:
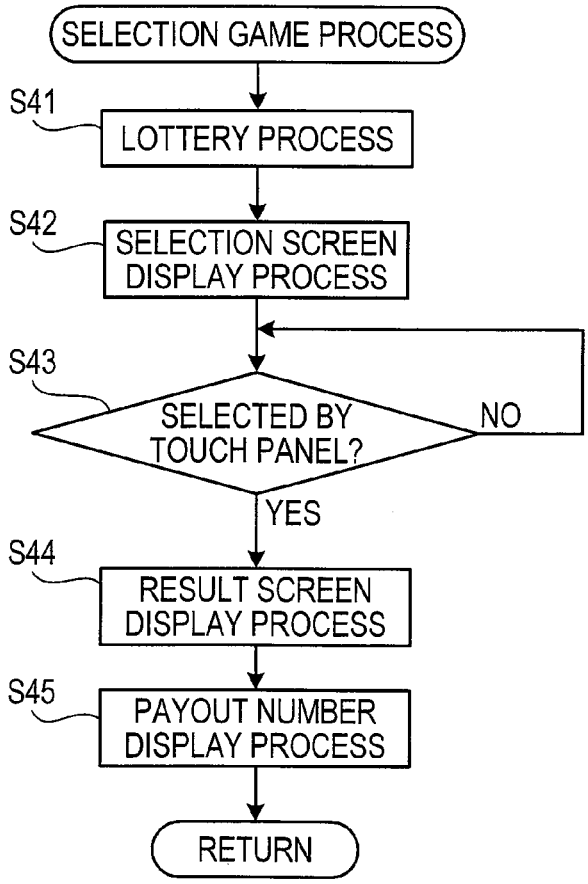
FIG. 16 is a flowchart of a selection game process program in accordance with one or more aspects of the present invention.

A sub process of the selection game process of S18 will be described with reference to FIG. 16. FIG. 16 is a flowchart of the sub process of the selection process in the slot machine 1 of the embodiment. Here, each of the programs shown in the flowcharts in FIG. 16 is stored in ROM 42 and RAM 43 of the slot machine 1, and executed in the game controller 100.

In the selection game process of S18, as shown in FIG. 16, in S41, the game controller executes the lottery process. In the lottery process, as mentioned above, the lottery for items to be arranged in the three treasure boxes is conducted.

In S42, the game controller 100 executes the selection screen display process. The game controller 100 sends the display control signal to the graphic board 68. Therefore, the selection screen, in which three treasure boxes 301, 302, and 303 are located, is displayed on the lower image display panel 6 (see FIG. 17).

The game controller 100 determines in S43 whether or not the player selects with the touch panel 11 one treasure box among three treasure boxes 301, 302, or 303. This determination is based on the input signal from the touch panel 11.

If it is determined that none of the treasure boxes 301, 302, and 303 is not selected by the player (S43:NO), the procedure waits in S43 until the player selects with the touch panel 11 any of the treasure boxes 301, 302, or 303.

If it is determined that any of the treasure boxes 301, 302, or 303 is selected by the player with the touch panel 11 (S43:YES), the procedure will be shifted to S44. In S44, the game controller 100 sends the display control signal to the graphic board 68. Therefore, the result screen is displayed on the lower image display panel 6.

Here, if the diamond is arranged in the selected treasure box by the player among three treasure boxes 301,302, or 303, the result screen with the character image 311 shown in FIG. 19 is displayed. If the gold item is arranged in the selected treasure box by the player among three treasure boxes 301,302, or 303, the result screen with the character image 312 shown in FIG. 20 is displayed. On the other hand, if the selected treasure box by the player is empty, none of the character images is displayed. Here, above display control is performed based on the selection information or the like stored in the RAM 43 in addition to the input signal from the touch panel 11.

After that, the procedure is shifted to S45, and the game controller 100 executes the payout number display process. Concretely, if the diamond item is arranged in the treasure box selected by the player with the use of the touch panel 11 among three treasure boxes 301, 302, or 303, the game controller 100 calculates the outcome amount by multiplying the bet number (the bet information stored in the RAM 43) by 30. Also, if the gold item is arranged in the treasure box selected by the player with the use of the touch panel 11 among three treasure boxes 301, 302, or 303, the game controller calculates the outcome amount by multiplying the bet number (the bet information stored in the RAM 43) by 5. Also, if the selected treasure box by the player with the use of the touch panel 11 among three treasure boxes 301, 302, or 303 is empty, the game controller 100 calculates the outcome amount by multiplying the bet number (the bet information stored in the RAM 43) by zero.

The game controller 100 adds the calculated number to the credit number (the payout number obtained in the base game by the player) corresponding to the payout information stored in the RAM 43. And then, the game controller 100 writes the added number over the payout information stored in the RAM 43. The game controller 100 sends to the display control signal to the graphic board 68 and the payout information (the added number calculated in S45) stored in the RAM 43 is displayed in the payout number display portion 9 on the lower image display panel 6.

After that, the selection game is finished and the procedure will be returned to the main game process of FIG. 14.

As mentioned above, in the slot machine 1 of the embodiment, for example, as shown in FIG. 1 or 11, the unit game of the base game (slot game) is executed. Here, in the unit game, plural symbols 201 to 212 are variable displayed and then stopped. In the base game, if the winning combination is realized using the symbols displayed on the activated paylines L on the lower image display panel 6, the payout number corresponding to the winning combination (see FIG. 7) is provided (S31). In addition, the payout number corresponding to the number of the activated paylines L (see FIG. 8) is additionally provided to the player (S32).

Here, as shown in FIG. 8, the more paylines are activated, the more additional payout number is increased. Also, the bet number for the unit game of the base game is set based on the bet number per activated payline L by the operation button 110 to 114 arranged on the control panel 20 of FIG. 3 (S11).

Therefore, the player, who wants interest such as that the additional payout number can be provided, may have the motivation for activation more paylines L. At a result, the total bet number may be increased. Also, the more total bet number is increased, the more payout number is increased. At a result, the payout number corresponding the input amount predefined (namely payout ratio) may not be greatly-changed. Therefore, the payout ratio of the slot machine 1 may be easily adjusted.

In the slot machine 1 of the embodiment, the motivation for the activation more payline L can be provided to the player, so the total bet number can be increased. Therefore, one or more aspects of invention can provide nonconventional slot machine.

In the slot machine 1 of the embodiment, in the unit game in the base game, for example, as shown in FIG. 12, if three "Gold Box" symbols 212 are displayed on the lower image display panel 6 whether being repositioned on the activated payline L (S15:YES), the free game, which is one of the bonus games, will occur. In the free game, the bet number and the number of the activated paylines L in the unit game of the base game is carried on and the slot game is executed without betting the coins or the like. Also, the free game will be executed twenty times at maximum (S16 and S58).

In the free game, the lottery is performed every game to determine plural symbols 201 to 211, and 213 to be repositioned on the payline L (S53). Therefore, it is determined whether or not the "Sawfish" symbol 213 will be displayed on the lower image display panel 6 (namely, the trigger event will be occurred).

If the number of the games in which the "Sawfish" symbol 213 is displayed on the lower image display 6 reaches three based on the lottery result (S61:YES), the free game will be finished even though the number of the executed free games does not reach twenty (S58:NO).

Accordingly, the player may have the sense of tension that the free game may finish without executing the free game twenty times. Also, the player can easily understand the game result related to the finish of the free game by the "Sawfish" symbol 213 displayed on the lower image display panel 6. If the number of the game, in which the "Sawfish" symbol 213 is displayed on the lower image display panel 6, is three, the free game will be finished even though the number of the free game does not reach. Therefore, the player may have a sense of progressively tension.

In the free game, when the number of the executed games reaches "20" (S58:YES), the free game will be finished and the payout number, in which the bet number in the unit game of the base game which precedes the free game is multiplied by the forty, will be provided (S62). Therefore, the player may have the sense of accomplishment that the number of the free game reaches the twenty. Here, in the case where the free game is finished even though the number of the executed free games does not reach twenty (S58:NO, S61:YES), the payout ratio will be reduced, however, the payout ratio will be easily adjusted based on the payout number to be provided when the number of the executed free games reaches twenty.

Accordingly, in the slot machine 1 of the embodiment, the player may have the sense of the tension in the free game. At the result, the entertainment will be enhanced in the free game, and one or more aspects of the invention can provide nonconventional gaming machine and gaming method.

In the embodiment, each of the paylines L cross each one symbol among three repositioned symbols in vertical direction of each of the reels 5A, 5B, 5C, 5D, and 5E displayed on each of the display windows 10A, 10B, 10C, 10D, and 10E. That is, each of the paylines L crosses each of the reels 5A, 5B, 5C, 5D, and 5E (see FIG. 9).

Here, each of the paylines L crosses each predetermined symbol among three symbols displayed on each of the reels 5A, 5B, 5C, 5D, and 5E in the slot machine 1.

In the embodiment, the player selects the number of the paylines to be activated among twenty five paylines L1 to L25 on the based of the operation of each of the buttons 110 to 114.

The payline L crosses each one of symbols on each of the reels 5A, 5B, 5C, 5D, and 5E. That is, the payline L crosses five symbols. In the winning determination process included in S31 of FIG. 1, it is determined whether or not the combination of the symbols displayed on the activated paylines L selected by the player is any of the winning combinations. If the winning combination is realized, the payout number corresponding to the realized winning combination is provided to the player. Accordingly, by selecting the paylines L, the player selects the symbol display areas corresponding to the selected paylines L.

In the embodiment, the selection operation for the paylines L may mean that "the selection operation for the symbol display areas to be target of determination of winning". However, one or more aspects of invention are not so limited. For example, the player can select desired the number of areas to be target of the winning combination among the fifteen symbols on the fifteen symbols areas by the touch panel 6. Here, in the embodiment, as shown in FIGS. 10 and 12, 3×5 matrix of fifteen symbols are displayed on the lower image display panel 6. Here, the player can selects the symbol display areas to be target for the determination of winning with the use of the touch panel 11 or the like.

In the base game, the unit game includes the start acceptance, the lottery of the symbols, the variably display of symbols, the stop of symbols, determination of the winning combination, and the payout. Executing the unit game may mean executing one game. In the embodiment, the steps of S11, S12, S13, S13, S14:NO, S17:NO, and S19 correspond to the unit game.

In the free game of the embodiment, the successive steps of S53, S54, S55, and S56 of FIG. 12 make up the unit game. The free game of the embodiment skips the S1 of the start acceptance process in the same manner as common free games. Also, in the free game of the embodiment, in which the payout number obtained will be provided with the payout number in the base game, the payout process of S19 may be skipped. At a result, "the number of the executed free games is twenty" may mean "above successive steps are executed twenty times repeatedly".

Here, the bet number may be necessary in the free game. In this case, the bet number may be lower than the minimum bet number to execute the base game.

Also, in the embodiment, it is determined in S15 and S17 of FIG. 14 whether or not the procedure will be shifted to the bonus game (free game or selection game), and then the payout process is executed in S19 of FIG. 14. That is, if the procedure is shifted to the bonus game (free game or selection game), as mentioned above, the outcome amount by summing the payout number obtained in the base game by the player and the payout number obtained bonus game (free game or selection game) following the base game will be provided to the player.

Here, the payout process of S19 can be executed next to the step of S14 of FIG. 14, and the steps of S15 and S17 can be executed after the payout process.

In this case, during the bonus game (free game or selection game), the process (hereinafter, "additional process") in which the payout number obtained in only the bonus game is provided. Therefore, in this case, the unit game of the base game may be defined as the successive steps of S11, S12, S13, S14, and S19 of FIG. 14. If this definition is applied to the free game in the embodiment, steps of S53, S54, S55, S56, and above the additional process are successive steps. In this case, the bet number may be necessary in the free game and the bet number may be lower than the minimum bet number to execute the base game.

In the embodiment, when the unit game of the base game is executed, the total bet number per the unit game is set by multiplying the number of the activated paylines L by the bet number per the payline L (see S12 of FIG. 14).

For example, in a case where one bet is equal to one dollar, if the number of the activated paylines L is "20" and the bet number per payline L is "5", the tonal number is "100", so the player bets 100 dollars on one unit game.

Here, in a case where above example is applied in the embodiment, if one bet is equal to one dollar, the number of the activated paylines is one, and the bet number per payline L, the total bet number is "1". Therefore, the player bets one dollar on one unit game. Here, one dollar is minimum bet number to play the game. In the bonus game (free game or selection game) which is profitable for the player, the player can play the game without betting.

Here, the bonus game (free game or selection game) is profitable for the player even though the free game is executed with the bet value which is lower than the minimum bet number to execute the unit game.

In this case, for example, during the free game, if the player operated any of each button 104 to 108 and 110 to 114, only less than one dollar (for example, 10 cents) may be set. Also, the bet number is set by multiplying the bet number corresponding to the each of the buttons 110 to 114 (based on the input signal) by 0.01.

Here, aspects of the present invention are not limited to the above embodiment and various changes and modification can be done within the scope of the present invention.

For example, in the start acceptance process of S11, at first, the bet number per activated payline L is set, and then the number of the activated paylines may be set.

That is, the game controller 100 may allow the operation of the RED BET 1 PER LINE button 110, the BET 5 PER LINE button 111, the BET 10 PER LINE button 112, the BET 20 PER LINE button 113, and the BLACK BET 40 PER LINE button 114. And then, if the player operates any of above button, the game controller 100 may set the bet number.

After the bet number is set, the game controller 100 may allow the operation of the PLAY 11 LINE button 104, the PLAY 5 LINE button 105, the PLAY 9 LINE button 106, the PLAY 20 LINE button 107, and the PLAY 25 LINE button 108. And then, if any of above buttons is operated, the game controller 100 sets the number of the activated paylines L based on the operation by the player, and set which paylines among twenty five paylines L are activated.

In this case, if the player operates any of the PLAY 1 LINE button 104, the PLAY 5 LINE button 105, the PLAY 9 LINE button 106, the PLAY 20 LINE button 107, or the PLAY 25 LINE button 108, all of reels 5A, 5B, 5C, 5D, and 5E will be started to spin on the lower image display panel 6.

Also, the player can change the bet number per the activated payline by operating the RED BET 1 PER LINE button 110, the BET 5 PER LINE button 111, the BET 10 PER LINE 112, the BET 20 PER LINE 113, or the BLACK BET 40 PER LINE button 114 again, before the PLAY 1 LINE button 104, the PLAY 5 LINE button 105, the PLAY 9 LINES button 106, the PLAY 20 LINES button 107, or the PLAY 25 LINES button 108, even though, the bet number per activated payline L is already determined on the basis of the button operation of the RED BET 1 PER LINE button 110, the BET 5 PER LINE button 111, the BET 10 PER LINE 112, the BET 20 PER LINE 113, or the BLACK BET 40 PER LINE button 114.

If the player wants to start spinning all of the reels 5A, 5B, 5C, 5D, and 5E in current unit game without change for the bet number per the activated payline L, the player has to operate the RED BET 1 PER LINE button 110, the BET 5 PER LINE button 111, the BET 10 PER LINE 112, the BET 20 PER LINE 113, or the BLACK BET 40 PER LINE button 114 without operating the PLAY 1 LINE button 104, the PLAY 5 LINE button 105, the PLAY 9 LINES button 106, the PLAY 20 LINES button 107, or the PLAY 25 LINES button 108.

In the base game, if the winning combination is realized on the activated payline on the lower image display 6, the payout number corresponding to the number of the activated paylines will be additionally provided (S32). However, if the winning combination is realized based on the displayed scatter symbols regardless of whether being displayed on the activated payline, the payout number corresponding to the number of the activated paylines (see FIG. 8) will be additionally provided to the player.

In the embodiment, the payout number corresponding to the number of the activated paylines is any of "20", "100", "180", "400", or "500" based on the number of the activated paylines. Here, the payout number is fixed value (see FIG. 8). However, the payout number can be set by multiplying the number of the activated paylines by the predetermined value.

Figure 28:
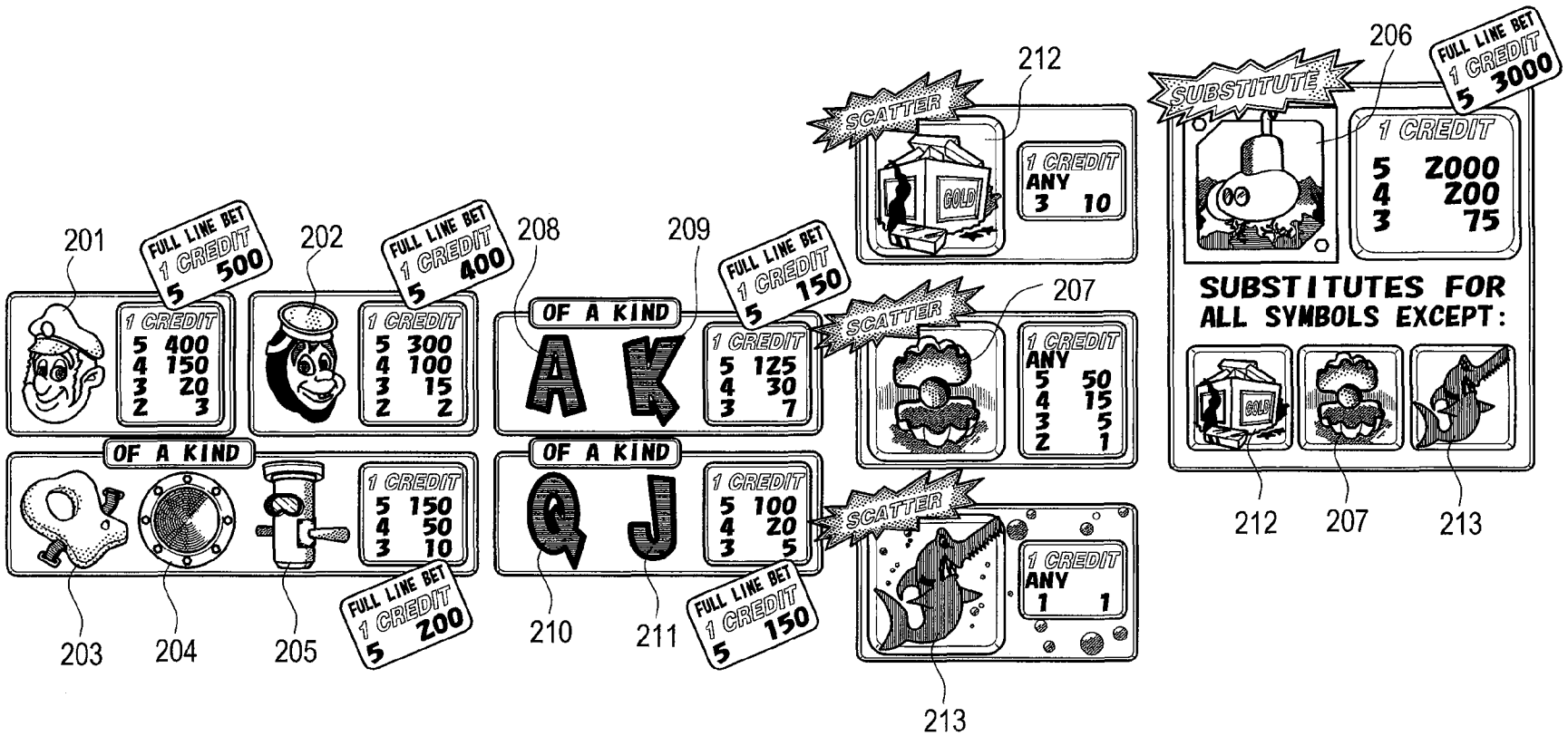
FIG. 28 is a payout table of winning combinations and payout numbers thereof in the base game and a bonus game in accordance with one or more aspects of the present invention.

Also, for example, a payout table shown in FIG. 28 can be used in place of the payout tables shown in FIG. 7 or 8. In this case, if all of paylines are activated, the payout number corresponding to the number of the activated paylines will be provided to the player.

That is, according to the payout table shown in FIG. 28, five "Captain" symbols 201 are repositioned on the activated paylines L and all of the paylines are activated, the payout number of 500 credits per one bet will be provided.

In the same manner, the payout numbers, to be provided if five the "Scuba" symbols 202, the "Lifevest" symbols 203, the "Radar" symbols 204, the "Periscope" symbols 208, the "King" symbols 209, the "Queen" symbols 210, or the "Jack" symbols are repositioned on the activated paylines and all of the paylines are activated, are defined in the payout table.

This may provide the motivation of executing with all of paylines to the player. Also, all of twenty five paylines L1 to L25 may be effectively used in the game.

Also, in the base game, if all of the paylines are activated, the game controller 100 can use symbol columns shown in FIG. 25 or 25 in place of the symbol rows columns shown in FIG. 4, as symbol. columns displayed on each of the reels 5A, 5B, 5C, 5D, and 5E.

Figure 24:
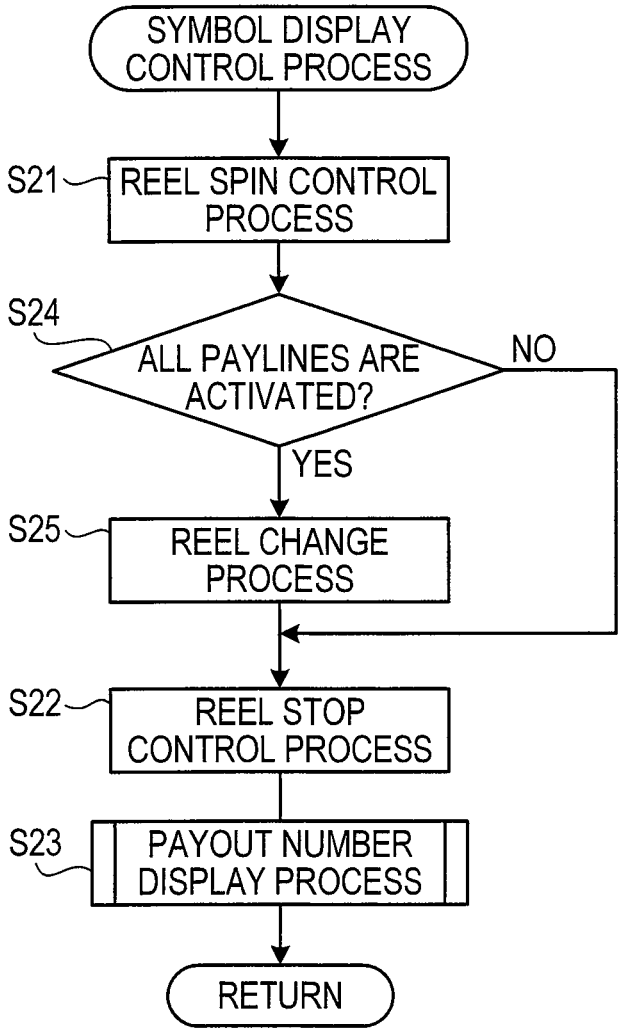
FIG. 24 is a flowchart of a symbol display control process program in accordance with one or more aspects of the present invention.

Thus, the game controller 100 may executes the symbol display control process shown in FIG. 24 in place of the symbol display process shown in FIG. 15.

In the symbol display control process shown in FIG. 24, steps of S24 and S25 are added at the point between S21 and S22 in the symbol display control process shown in FIG. 15. Here, the steps of S24 and S25 will be described. In the symbol display control process, the game controller 100 shifted to S24 after reel spin control process shown in FIG. 24 is executed, and determines whether or not all of the paylines L are activated. If it is determined that all of paylines L are not activated (namely, at least one payline is not activated) (S24: NO), the reel stop control process of S22 will be executed without other than that.

On the other hand, if it is determined that all of the paylines L are activated (S24:YES), the procedure will be shifted to S25. In S25, the game controller 100 executes the reel change process.

That is, the game controller 100 changes symbol columns to be displayed on the outer surfaces of each of the reels 5A, 5B, 5C, 5D, and 5E, from the symbol columns shown in FIG. 4 to the symbol columns shown in FIG. 25 or FIG. 26.

Here, the control signal indicating to change the reel is output from the game controller 100 to the graphic board 68. Therefore, the graphic board 68 changes the symbol columns displayed on the outer surface of the each of the spinning reels 5A, 5B, 5C, 5D, and 5E, from the symbol columns shown in FIG. 4 to the symbol columns shown in FIG. 25 or 26. And then, the game controller 100 executes the reel stop control process of S22.

In this case, when the payout number is provided to the player, if all of paylines are not activated, namely at least one payline is not activated (S24:YES), symbol columns displayed on each of the reels 5A, 5B, 5C, 5D, and 5E are changed and the changed symbol columns are spin (S25).

Therefore, the player, who wants the interest such as that each of the reels 5A, 5B, 5C, 5D, and 5E of the changed symbol columns are spin, may have the motivation to bet more bet number. At a result, total bet number will be increased.

Also, the player can have the chance to play the game with all of the paylines L. Further, if all of paylines are activated, all of twenty five paylines L1 to L25 embedded in the slot machine 1 are maximally and effectively used.

The alignment of symbols of each symbol column is changed in the symbol column shown in FIG. 26, but the kinds and number of symbols in the symbol column is not changed.

On the other hand, in the symbol column shown in FIG. 25, the "Captain" symbols 201 are substituted from the part of the "Jack" symbols shown in FIG. 4. Therefore, the probability of the winning combination including the "Captain" symbol 201 will be increased. Here, the payout number corresponding to the winning combination including the "Captain" symbol 201 is higher than the payout number corresponding to the winning combination including the "Jack" symbol 211 (see FIG. 7). Accordingly, the player, who wants more payout number, has the motivation of the activation all of the paylines L, the total bet number will be increased with certainty. Also, the more total bet number is increased, the more payout number is increased. At a result, the payout number corresponding the input amount predefined, namely payout ratio, may not be greatly-changed. Therefore, the payout ratio of the slot machine 1 may be easily adjusted.

The onlookers may understand that higher payout number can be obtained by using the symbol columns (for example, symbol columns shown in FIG. 25) which symbols making up the winning combination corresponding to the higher payout number. The onlooker's interest may evoke.

Here, if the paylines are activated with the predetermined number, the symbol columns displayed on the surface of each reel 5A, 5B, 5C, 5D, and 5E will be changed based on the number of the activated paylines L even though all of the paylines L are not activated.

For example, if the number of the activated paylines is one, the symbol column displayed on the surface of reel 5A will be changed. If the number of the activated paylines is five, the symbols column displayed on the surfaces of the reels 5A and 5B will be changed. If the number of the activated paylines is nine, the symbol columns displayed on the surfaces of the reels 5A, 5B, and 5C will be changed. If the number of the activated paylines is twenty, the symbol columns displayed on the surfaces of the reels 5A, 5B, 5C, and 5D will be changed. If the number of the activated paylines is twenty five, the symbol columns displayed on the surfaces of the reels 5A, 5B, 5C, and 5D will be changed.

In this case, above effects may be made.

Also, in the base game, if all of the paylines L are activated, the game controller 100 can change the lottery setting for the base game. Consequently, the game controller 100 executes the base game lottery process shown in FIG. 27 in place of the base game lottery process of S13 shown in FIG. 14.

Figure 27:
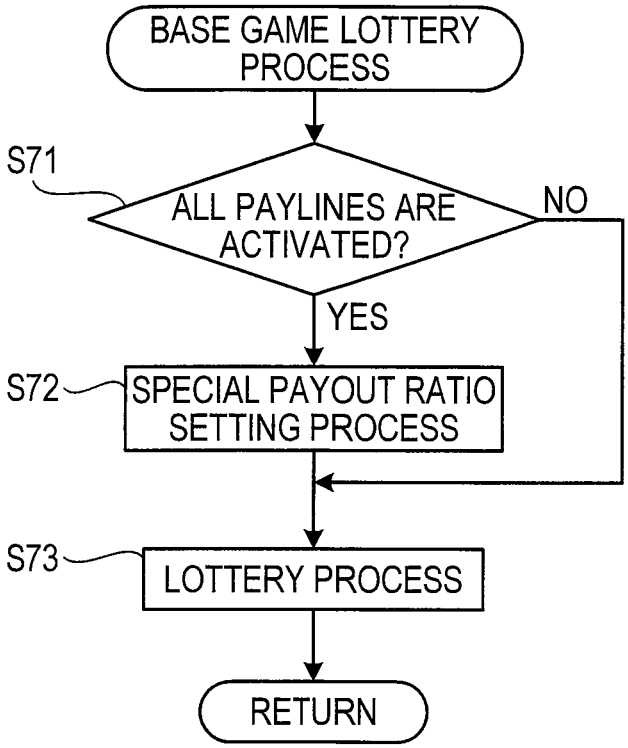
FIG. 27 is a flowchart of a base game lottery process program in accordance with one or more aspects of the present invention.

In the base game lottery process shown in FIG. 27, in S71, the game controller 100 determines whether or not all of the paylines are activated. This determination is based on the activation information stored in the RAM 43. If it is determined that any of the paylines is not activated (S71:NO), the procedure will be shifted to the lottery process of S73 without any process.

On the other hand, if it is determined that all of the paylines are activated (S71:YES), the procedure will be shifted to S72.

In S72, the game controller 100 executes special payout ratio setting process. The game controller 100 increases the probability of the winning combination corresponding to higher payout number, so the payout ratio will be increased in particular.

And then, the game controller 100 shifts the procedure to the lottery process of S73, and executes the process which is the same as the symbol display control process of S13 based on the specially increased payout ratio.

In this case, when the payout number corresponding to the number of the activated paylines L (see FIG. 8) is provided to the player, if all of the activated paylines L are activated (S71:YES), the probability of winning combination corresponding to higher payout number is increased in particular. That is, the lottery setting is changed (S72). Therefore, the player, who wants the interest of the change for the lottery setting, may have the motivation of activation of all paylines L. Therefore, total bet number will be increased.

Also, the player can have the chance to play the game with all of the paylines L. Further, if all of paylines are activated, all of twenty five paylines L1 to L25 embedded in the slot machine 1 are maximally and effectively used.

If the lottery setting is changed (S72), the probability of the winning combination corresponding to higher payout number is increased. The payout ratio is increased in particular. Accordingly, the player, who wants more payout number, has the motivation of the activation all of the paylines L, the total bet number will be increased with certainty. Also, the more total bet number is increased, the more payout number is increased. At a result, the payout number corresponding the input amount predefined, namely payout ratio, may not be greatly-changed. Therefore, the payout ratio of the slot machine 1 may be easily adjusted.

Here, if the paylines L are activated with the predetermined number, the realizing probability of higher winning combination can be increased based on the number of the activated paylines L as shown below, even though all of the paylines L are not activated.

For example, if the number of the activated paylines L is one, the realizing probability of the winning combination constructed from the "Periscope" symbol 205 will be increased.

Also, if the number of the activated paylines L is five, the realizing probability of the winning combination constructed from the "Periscope" symbol 205 and the realizing probability of the winning combination constructed from the "Radar" symbol 204 will be increased.

Also, if the number of the activated paylines L is nine, the realizing probability of the winning combination constructed from the "Periscope" symbol 205, the realizing probability of the winning combination constructed from the "Radar" symbol 204, and realizing probability of the winning combination constructed from the "Lifevest" symbol 203 will be increased.

Also, if the number of the activated paylines L is twenty, the realizing probability of the winning combination constructed from the "Periscope" symbol 205, the realizing probability of the winning combination constructed from the "Radar" symbol 204, the realizing probability of the winning combination constructed from the "Lifevest" symbol 203, and the realizing probability of the winning combination constructed from the "Scuba" symbol 202 will be increased.

Also, if the number of the activated paylines L is twenty five, the realizing probability of the winning combination constructed from the "Periscope" symbol 205, the realizing probability of the winning combination constructed from the "Radar" symbol 204, the realizing probability of the winning combination constructed from the "Lifevest" symbol 203, the realizing probability of the winning combination constructed from the "Scuba" symbol 202, and the realizing probability of the winning combination constructed form the "Captain" symbol 201 will be increased.

At above situation, each of the effects will be made.

In the free game, if the number of games, in which the "Sawfish" symbol 213 is displayed on the lower image display panel 6, reaches one, the free game will be finished, even though the number of the free games does not reach twenty. In this case, the player may have the sense of the tension that the free game may finish without executing the free game twenty times.

Also, the player can easily understand the game result related to the finish of the free game by the "Sawfish" symbol 213 displayed on the lower image display panel 6.

Also, one or more aspects of the invention may provide sense of accomplishment that the number of the executed free games reaches twenty to the player.

Here, in the case where the free game is finished even though the number of the executed free games does not reach twenty (S58:NO, S61:YES), the payout ratio will be reduced, however, the payout ratio will be easily adjusted based on the payout number to be provided when the number of the executed free games reaches twenty.

In the free game, when it is determined the "Sawfish" symbol 213 will be displayed on the lower image display panel 6 based on the lottery result conducted every unit game, at the time, the bonus game can be finished even though In this case, each of the control processes for reels (S54 and S55) in the game are not executed and the player may have the sense of tension that the free game may finish without executing the free game twenty times.

In this case, if the games, in which the "Sawfish" symbol 213 does not appear on the lower image display panel 6, are repeatedly executed, the number of the executed free games may reach twenty. Therefore, the player may have the sense of accomplishment such as that the number of the executed free games reaches twenty.

Here, in the case where the free game is finished even though the number of the executed free games does not reach twenty (S58:NO, S61:YES), the payout ratio will be reduced, however, the payout ratio will be easily adjusted based on the payout number to be provided when the number of the executed free games reaches twenty.

In the embodiment, the payout number, which will be provided when the number of executed free game reaches twenty, is calculated by multiplying the bet number in the unit game of the base game which precedes the base game (S62). In one or more aspects of the invention, the payout number may be in proportion to the bet number in the unit game of the base game which precedes the free game. Also, the payout number may be fixed value (for example, 1000). Also, the payout number corresponding to executing the free games twenty times may be in proportion to or inversely proportional to the number of displayed the "Sawfish" symbols 213

In the free game, it may be determined whether or not the payout number is provided. In this case, the free game process shown in FIG. 29 will be executed in place of the free game shown in FIG. 21.

Figure 29:
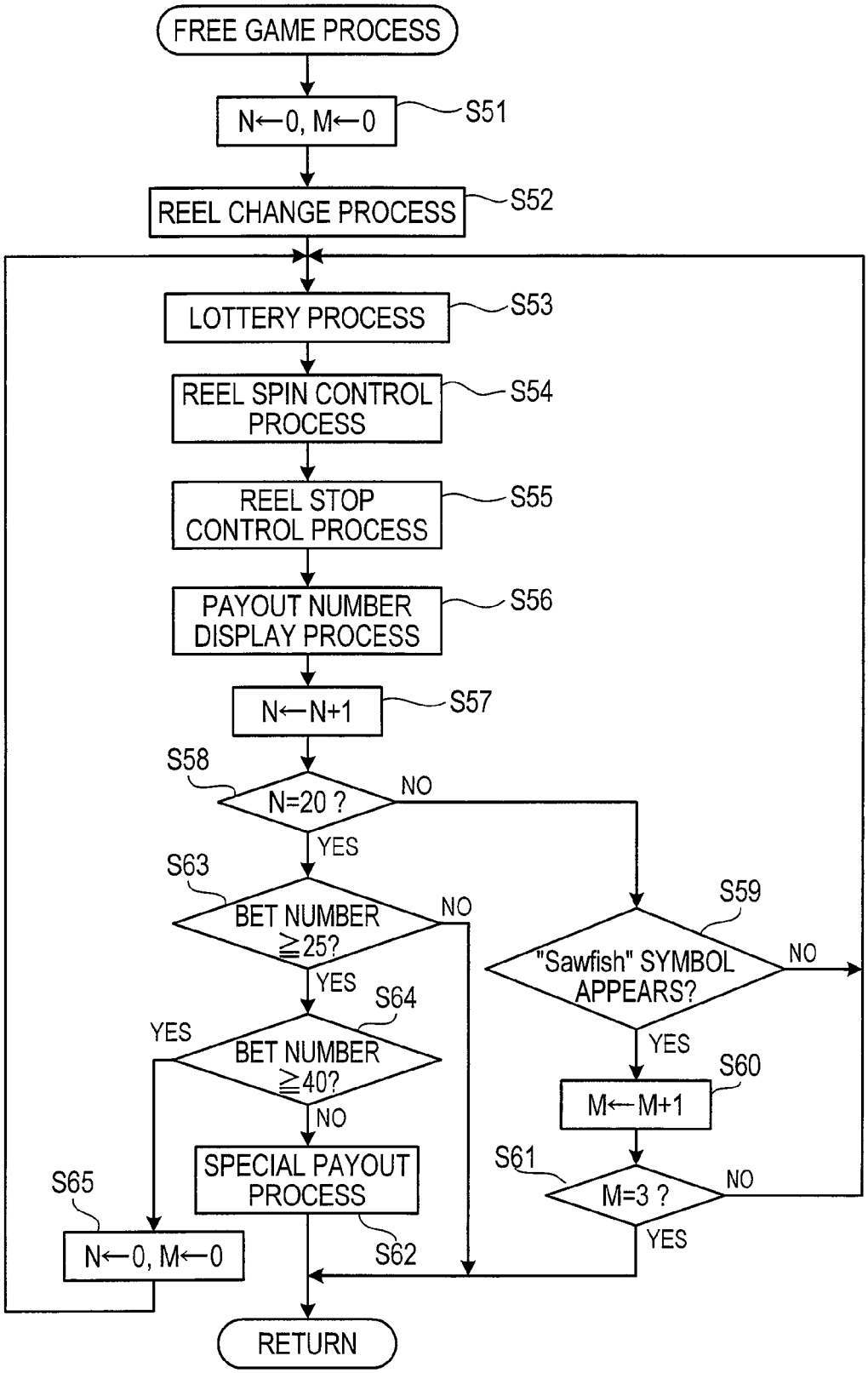
FIG. 29 is a flowchart of a free game process program in accordance with one or more aspects of the present invention.

Here, in the free game shown in FIG. 29, the steps of S63, S64, and S65 are added in between S58 and S62 of the free game shown in FIG. 21. Here, the steps of S63, S64, and S65 will be described. In the free game shown in FIG. 29, if it is determined in S58 that the variable number N is "20", the procedure will be shifted to S63.

In S63, the game controller 100 determines whether or not the bet number in the latest unit game of the base game which precedes the free game is "25". This determination is based on the bet information stored in the RAM 43.

If it is determined that the bet number in the latest unit game of the base game which precedes the free game is not "25" or more (S63:NO), the free game will be finished without providing the payout number corresponding to that the number of the executed free games reaches twenty. On the other hand, if it is determined that the bet number in the latest unit game of the base game which precedes the free game is "25" or more (S63:YES), the procedure will be shifted to S63.

In S64, the game controller 100 determines whether or not the bet number for the unit game of the base game in the latest base game which precedes the selection game in the latest unit game of the base game which precedes the free game is "40" or more. This determination is based on the bet information stored in the RAM 43. If it is determined that the bet number in the latest unit game of the base game which precedes the free game is not "40" or more (S64:NO), the procedure will be shifted to S62 and the payout number corresponding to that the number of the executed free games reaches twenty will be provided, and then the free game will be finished.

On the other hand, if it is determined that the bet number in the latest unit game of the base game which precedes the free game is "40" or more (S64:YES), the procedure will be shifted to S65.

In S65, the game controller 100 assigns "0" to the variable number N and M reserved in the RAM 43 and the procedure will be returned to S53. If the bet number in the latest unit game of the base game which precedes the free game is more than "40", when the procedure will be shifted to the free game, the payout number corresponding to that the number of games reaches twenty is not provided and the new free game will be started again. Accordingly, the free game is executed again and again until the number of the games in which the "Sawfish" symbol 213 is displayed on the lower image display panel 6 reaches three (S61:YES).

Therefore, the player, who wants the interest such as that the free game will be newly executed, may have the motivation of activating more paylines L. At a result, the total bet number will be increased. Also, the more total bet number is increased, the more payout number is increased. At a result, the payout number corresponding the input amount predefined, namely payout ratio, may not be greatly-changed. Therefore, the payout ratio of the slot machine 1 may be easily adjusted.

One or more aspects of the invention can be applied to arts in which the award to be provided based on the symbol display area designated to the target for the determination of winning in the gaming machine.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A gaming machine comprising:

a display having symbol display areas, each of the symbol display areas displaying a symbol, the symbol display areas being arranged in a matrix of m number of columns and n number of rows, and symbols belonging to each symbol column, which includes a plurality of symbols, being displayed in the symbol display areas in each of the m columns, a first payout table memory storing a relation between winning combinations and outcomes, a second payout table memory storing a relation between a number of paylines of the symbol display areas which is selected by a player and an additional outcome corresponding to the number of the selected paylines, and a controller programmed to:

(a) select one or more paylines of the symbol display areas, (b) for the m number of columns, modify a symbol construction of a number of the symbol columns x according to a number of the paylines selected in (a) such that the number of the symbol columns modified x increases as the number of the selected paylines increases, and the symbol construction of each of the modified symbol columns is modified by adding or subtracting an existing column symbol to or from the respective symbol columns so that a winning combination with a higher additional outcome is provided, the number of symbol columns modified x being greater than zero and less than or equal to the m number of columns, (c) determine whether a winning combination is realized based on the symbols displayed on the selected one or more paylines, (d) calculate an outcome based on the realized winning combination and a bet value per the selected one or more pay lines with reference to first payout memory, and (e) add to the calculated outcome the additional outcome obtained based on the number of selected paylines with reference to the second payout table memory.

2. The gaming machine according to claim 1, wherein the controller is programmed to change the calculated outcome when all pay lines are selected.

3. The gaming machine according to claim 1, wherein the controller is programmed to increase the calculated outcome.

4. The gaming machine according to claim 1, wherein no more than m−1 number of symbol columns are modified.

5. The gaming machine according to claim 1, wherein when a maximum number of paylines are selected, m number of symbol columns are modified.

6. The gaming machine according to claim 1, wherein when a maximum number of paylines are selected, m−1 number of symbol columns are modified.

7. The gaming machine of claim 1, wherein the symbol construction of a symbol column is modified by at least one of modifying a number of symbols appearing in a column or substituting a first symbol with a second symbol.

8. A gaming machine comprising:

reels having symbols, a display having symbol display areas, each of the symbol display areas displaying a symbol, the symbol display areas being arranged in a matrix of m number of columns and n number of rows, and symbols belong to each of the reels being displayed in the symbol display areas in each of the m number of columns, a first payout table memory storing a relation between winning combinations and outcomes;

a second payout table memory storing a relation between a number of paylines of the symbol display areas which is selected by a player and an additional outcome corresponding to the number of the selected paylines, and a controller programmed to:

(a) select one or more paylines of the symbol display areas, (b) for the m number of columns, which correspond to a same m number of reels, modify a symbol construction of a number of the reels x according to a number of paylines selected in (a) such that the number of the reels modified x increases as the number of the selected paylines increases, and the symbol construction of each of the modified reels is modified by adding or subtracting existing reel symbols to and from the respective reels so that a winning combination with a higher additional outcome is provided, the number of reels modified x being greater than zero and less than or equal to the m number of reels, (c) determine whether a winning combination is realized based on the symbols displayed on the selected one or more pay lines, (d) calculate an outcome based on the realized winning combination and a bet value per the selected one or more paylines with reference to the first payout table memory, and (e) add to the calculated outcome the additional outcome obtained based on the number of selected paylines with reference to the second payout table memory.

9. The gaming machine according to claim 8, wherein the controller is programmed to change the symbols when all paylines are selected.

10. The gaming machine according to claim 8, wherein the symbols include a first symbol, the first symbol making up a profitable winning combination, and the controller is programmed to change the symbols by increasing a number of the first symbols on one or more of the reels to be modified.

11. The gaming machine according to claim 8, wherein no more than m−1 number of reels are modified.

12. The gaming machine according to claim 8, wherein when a maximum number of pay lines are selected, m number of reels are modified.

13. The gaming machine according to claim 8, wherein when a maximum number of paylines are selected, m−1 number of reels are modified.

14. The gaming machine of claim 8, wherein the symbol construction of a reel is modified by at least one of modifying a number of symbols appearing in a modified column or substituting a first symbol with a second symbol.

* * * * *